US009932712B2

(12) United States Patent
Meroz et al.

(10) Patent No.: US 9,932,712 B2
(45) Date of Patent: Apr. 3, 2018

(54) SPIRAL RING FULL ROAD INTERCHANGE SYSTEM

(71) Applicants: Gilead Meroz, Herzliya (IL); Yaron Toren, Jerusalem (IL)

(72) Inventors: Gilead Meroz, Herzliya (IL); Yaron Toren, Jerusalem (IL)

( * ) Notice: Subject to any disclaimer, the term of this patent is extended or adjusted under 35 U.S.C. 154(b) by 118 days.

(21) Appl. No.: 14/909,119

(22) PCT Filed: Jul. 31, 2014

(86) PCT No.: PCT/IB2014/063589

§ 371 (c)(1),
(2) Date: Jan. 31, 2016

(87) PCT Pub. No.: WO2015/015455

PCT Pub. Date: Feb. 5, 2015

(65) Prior Publication Data

US 2016/0177514 A1 Jun. 23, 2016

Related U.S. Application Data

(60) Provisional application No. 61/861,491, filed on Aug. 2, 2013.

(51) Int. Cl.
*E01C 1/04* (2006.01)
*E01C 1/00* (2006.01)

(52) U.S. Cl.
CPC ..... *E01C 1/04* (2013.01); *E01C 1/002* (2013.01)

(58) Field of Classification Search
CPC ... E01C 1/04; E01C 1/002; E01C 1/00; E01C 1/02
See application file for complete search history.

(56) References Cited

U.S. PATENT DOCUMENTS 2,941,454 A * 6/1960 Cedeno ..... E01C 1/04 404/1
2,949,067 A 8/1960 Cedeno
3,238,854 A 3/1966 Okubo
3,394,638 A 7/1968 Burrell
3,847,496 A 11/1974 Stankiewicz
4,272,210 A 6/1981 Shoji et al.
4,592,673 A 6/1986 Lee
4,630,961 A 12/1986 Hellwig
4,861,184 A 8/1989 Mier
4,927,288 A 5/1990 Raswant
4,953,249 A 9/1990 Warwick
(Continued)

FOREIGN PATENT DOCUMENTS

BE 638746 A 2/1964
CA 2378999 A1 9/2003
(Continued)

*Primary Examiner* — Abigail A Risic
(74) *Attorney, Agent, or Firm* — Alphapatent Associates, Ltd.; Daniel J. Swirsky

(57) ABSTRACT

A spiral road junction system for connecting a plurality of highway spokes via a spiral road junction comprising adjacent-spoke connecting roads associated with each highway spoke, and a ring-road interchange traversing all the highway spokes. The ring-road interchange provides a continuous path from a slip road diverging from an entry highway spoke to an access road merging with an exit highway spoke.

16 Claims, 26 Drawing Sheets

(56) References Cited

U.S. PATENT DOCUMENTS

| | | | | |
|---|---|---|---|---|
| 4,955,751 | A | 9/1990 | Tsai | |
| 5,049,000 | A | 9/1991 | Mier et al. | |
| 5,520,478 | A | 5/1996 | Yin-Lung | |
| 5,538,357 | A | 7/1996 | Boswell, Sr. | |
| 5,795,095 | A | 8/1998 | Heller | |
| 5,921,701 | A | 7/1999 | Clayton | |
| 6,312,187 | B1 | 11/2001 | Walter | |
| 6,685,386 | B1 | 2/2004 | Lee | |
| 7,234,891 | B2 | 6/2007 | Futoshi et al. | |
| 7,425,104 | B2 | 9/2008 | Buteliauskas et al. | |
| 2002/0076276 | A1* | 6/2002 | Troemel | E01C 1/02 404/1 |
| 2004/0184879 | A1 | 9/2004 | Winkler | |
| 2005/0008432 | A1 | 1/2005 | Lindsey | |
| 2006/0099029 | A1 | 5/2006 | Hazan | |
| 2006/0216111 | A1 | 9/2006 | Jacky | |
| 2007/0086855 | A1 | 4/2007 | Niiya et al. | |
| 2007/0189851 | A1 | 8/2007 | Guoliang | |
| 2007/0237576 | A1 | 10/2007 | Peng | |
| 2007/0258759 | A1 | 11/2007 | Buteliauskas | |
| 2008/0033631 | A1 | 2/2008 | Yin | |
| 2008/0152426 | A1 | 6/2008 | Liu et al. | |
| 2008/0267700 | A1 | 10/2008 | Yin | |
| 2009/0010711 | A1 | 1/2009 | Yin | |
| 2009/0035058 | A1 | 2/2009 | Berman et al. | |
| 2009/0052983 | A1 | 2/2009 | Goj | |
| 2009/0148233 | A1 | 6/2009 | Remy | |
| 2010/0303544 | A1 | 12/2010 | Xuan | |
| 2011/0243657 | A1 | 10/2011 | Yeo | |
| 2012/0275856 | A1 | 11/2012 | Sutchiewcharn et al. | |
| 2013/0011190 | A1 | 1/2013 | Gingrich, Sr. | |
| 2013/0259566 | A1 | 10/2013 | Oudeh | |
| 2013/0279977 | A1 | 10/2013 | Loro | |
| 2014/0205376 | A1 | 7/2014 | Derenoncourt | |
| 2014/0352229 | A1 | 12/2014 | Gustafson et al. | |
| 2014/0377000 | A1 | 12/2014 | Chen et al. | |
| 2015/0193562 | A1* | 7/2015 | Chan | E01C 1/02 703/1 |

FOREIGN PATENT DOCUMENTS

| | | | |
|---|---|---|---|
| CN | 102286906 | A | 12/2011 |
| DE | 4135693 | A1 | 4/1993 |
| GB | 302376 | A | 12/1928 |
| GB | 848739 | A | 9/1960 |
| GB | 2202562 | A | 9/1988 |
| GB | 2466279 | A | 6/2010 |
| WO | 1997038166 | A1 | 10/1997 |
| WO | 2001094702 | A1 | 12/2001 |
| WO | 2006060950 | A1 | 6/2006 |
| WO | 2010058413 | A1 | 5/2010 |
| WO | 2011077189 | A1 | 6/2011 |
| WO | 2011099954 | A1 | 8/2011 |
| WO | 2012061925 | A1 | 5/2012 |
| WO | 2012171321 | A1 | 12/2012 |
| WO | 2013039432 | A2 | 3/2013 |

* cited by examiner

SPIRAL RING FULL ROAD INTERCHANGE SYSTEM

CROSS-REFERENCE TO RELATED APPLICATIONS

This application is a U.S. National Phase Application under 35 U.S.C. 371 of International Application No. PCT/IB2014/063589, which has an international filing date of Jul. 31, 2014, and which claims priority and benefit from U.S. Provisional Patent Application No. 61/861,491, filed Aug. 2, 2013, the contents and disclosure of which are incorporated herein by reference in their entirety.

FIELD OF THE INVENTION

The present disclosure is directed to providing a spiral ring full interchange system. More specifically, the present disclosure relates to a system for connecting multiple highway spokes to each other via direct segments or direct crosspass road segments using a ring-road interchange.

BACKGROUND OF THE INVENTION

The exceptional urbanization, population growth, technological advancements recognized in all aspects of life in the 21st century present new challenges associated with the fast pace of modern life, in general with high impact related to transportation systems required for connecting people to economic/business opportunities, education, health services and the more.

The growth of population has increased dramatically the number of vehicles on the roads, resulting in high traffic capacity in cities and inter-cities, creating a growing and continuous need for improved and more effective transportation systems. Thus, the road junction becomes an essential component where its effectiveness, regarding transportation capacity, speed, space consumption and cost become more crucial to provide the necessary solution.

A full road interchange aims to provide a safe and smooth traffic flow between the various associated highway roads, passing through the road junction continuously. Junction may have limitations and drawbacks in three major aspects:

- Area—requirement to use very large areas for building a full road interchange, mainly due to trapped spaces. Further, answering transportation regulations may not be feasible for interchanges having total area below 147,000 cubic meters (about 15 hectares). This issue is of particular importance in dense and highly populated areas.
- Traffic—road design may particularly influence transportation capacity and driving speed and various other aspects of traffic flow, such as weaving (lane crossing) issues; sudden slowing down due to sharp curves and traffic 'bottlenecks'; drop of traffic effectiveness when adding lanes in the same direction; problematic correction of navigation errors (such as performing an about-turn); and navigational complexities for the road user.
- Cost—high cost may be associated with building of transportation-efficient interchanges (transition speed and traffic capacity); and, possibly further impact based upon the land value.

Various road junctions are known and include for example, the "Continuous flow cloverleaf type interchange" of U.S. Pat. No. 4,861,184 to Mier et al., which describes a continuous flow cloverleaf type interchange for accommodating traffic from a plurality of road surfaces and the "Road junction" of U.S. Pat. No. 7,425,104 to Buteliauskas et al., which describes a road junction with roads arrayed in three, four or five different directions through the use of overpasses or tunnels in two levels.

Buteliauskas may provide an improved solution over Mier with regard to the construction area and construction cost. Buteliauskas road junction describes a technical design of high capacity two-level road interchange without intersecting traffic flows and only four small overpasses, in a four-way system for example, allowing for constant speeds to be maintained. Further, the road junction is designed to allow entry into the center area of the interchange, to turn around and exit in any desired direction, where area in the center of the junction becomes free for infrastructure and property development.

Buteliauskas's road junction (FIG. 2, U.S. Pat. No. 7,425,104) allows for most of the traffic to flow forward, depriving the interchange from having a main traffic direction, by transforming the straight main road into a curved road, thus imposing speed slowdown and reduced road capacity. Further, the left turn is diverging from the main traffic direction and the right turn diverges from the main road upstream and outside the junction center.

It is noted that Buteliauskas's road junction presents a further transportation failure: when traveling within the interchange, the main traffic flow, mostly directed forward, forks to the right for a right turn, and forks to the left, for a left turn, which is out of keeping with accepted norms for an RTH driving system.

It is further noted that, the stated traffic speed with the Buteliauskas road junction is around 70 km/h (43.5 miles per hour) which forces the traffic to slow down from full highway speed (60-65 miles per hour in the US), resulting from the enforcement of circular traffic flow in order to utilize the central area. Further, Buteliauskas road junction offers limited flexibility by disallowing "direct" turns through the interchange central area making the traffic flow more complicated from the road user perspective.

The road user needs to be familiar with the junction system prior to entering and provides no means for correcting driving decisions, such as performing an about turn to return back, if needed.

Additionally, the Buteliauskas road junction does not answer various drawbacks such as high building cost high due to the construction are large requirements, road user possible confusion in a complex road system and provides no flexibility for better adaptation to the ground surface.

Other known existing road junction implementations include also the Stack (Maltezian cross) interchange, the Turbine interchange and the Roundabout interchange, responding only partially to the drawbacks and limitations, as specified hereinabove.

The current disclosure addresses the need to provide an effective, safe and smooth traffic flow for road users, without using traffic signals.

SUMMARY OF THE INVENTION

The embodiments described herein relate to a spiral ring full interchange system for connecting multiple highway spokes.

It is according to one aspect of the current disclosure to present a spiral road junction system connecting a plurality of highway spokes, the spiral road junction comprising: at least one cross-over connecting road associated with each highway spoke, the cross-over connecting road providing a continuous path from the inbound section of an entry highway spoke to the outbound section of an exit highway spoke, wherein the spiral road junction further comprises: a ring-road interchange comprising a continuous ring-shaped road surface traversing a plurality of spoke-traversing crosspasses, each spoke-traversing crosspass traversing a highway spoke; and the cross-over connecting road comprises: a slip road diverging from the inbound section of the entry highway spoke; an access road converging with the outbound section of the exit highway spoke; a ring-road interchange segment, the segment traversing all intermediate highway spokes between the entry highway spoke and the exit highway spoke; a ring-traversing crosspass segment providing a passage between the inside and the outside of the ring-road interchange; an inner connecting segment connecting the inside of the ring-traversing crosspass segment to the ring-road interchange.

The spiral road junction system further comprising at least one adjacent-spoke connecting road associated with each highway spoke, where the at least one adjacent-spoke connecting road connecting the inbound section of the entry highway spoke and the outbound section of an adjacent highway spoke.

Where appropriate, the at least one adjacent-spoke connecting road is disposed within the area contained within said ring-road interchange. Optionally, the at least one adjacent-spoke connecting road is disposed outside the area contained within the ring-road interchange. Accordingly, the at least one cross-over connecting road diverges from the inbound section upstream from the at least one adjacent-spoke connecting road.

In some embodiments, the spiral road junction system may be configured for connecting at least four highway spokes and further comprising at least one flyover intersection comprising at least a first link road connecting a first pair of the highway spokes, and at least one second link road connecting a second pair of the highway spokes, wherein the first link road traverses the second link road via a flyover intersection crosspass. Further, the at least one flyover intersection crosspass may comprise at least one of a bridge, a tunnel, a cutting and the like.

According to further embodiments, the spiral road junction system may be configured for connecting at least six highway spokes wherein the at least one flyover intersection further comprises at least a third link road connecting a third pair of said highway and the second link road traversing the third link road via a second flyover intersection crosspass.

Where appropriate, the ring-road interchange of the spiral road junction system further comprises at least one correction region disposed along the ring-road interchange segment diverging from the cross-over connecting road. Optionally, the correction region is disposed upstream from the access road segment.

Optionally, the spiral road junction system comprises at least one diverging region diverging from the cross-over connecting road and at least one converging region rejoining the ring-road interchange.

Optionally, the spiral road junction system, wherein the ring-road interchange comprises a continuous crosspass on one level. Where appropriate, the continuous path comprises at least one lane configured to provide a traffic-flow from the inbound section of the entry highway spoke along the ring-road interchange to the outbound section of the exit highway spoke, the traffic-flow requiring no crossing of lanes.

Where appropriate, the slip road comprises an inward spiral converging with said ring-road interchange from outside. Optionally, the slip road comprises an outward spiral converging with the ring-road interchange from inside.

As appropriate, the ring-traversing crosspass of the spiral road junction system is selected from a group consisting of an underpass crossing, an overpass crossing, a bridge, a tunnel, a cutting or combinations thereof.

As appropriate, the spoke-traversing crosspass of the spiral road junction system is selected from a group consisting of an underpass crossing, an overpass crossing, a bridge, a tunnel, a cutting or combinations thereof.

Another aspect of the current disclosure is presenting a spiral road junction system connecting N highway spokes, the spiral road junction comprising: at least one adjacent-spoke connecting road associated with each highway spoke, the at least one adjacent-spoke connecting road connecting the inbound section of the associated highway spoke and the outbound section of a second highway spoke; and at least one cross-over connecting road associated with each said highway spoke, the at least one cross-over connecting road providing a continuous path from the inbound section of the associated highway spoke to the outbound section of an Nth highway spoke, wherein the spiral road junction further comprises: a ring-road interchange comprising a continuous ring-shaped road surface traversing at least N spoke-traversing crosspasses, each spoke-traversing crosspass traversing a highway spoke; and the cross-over connecting road comprises: a slip road from the inbound section of the associated highway spoke; an access road to the outbound section of the Nth highway spoke; a ring-road interchange segment comprising at least N−2 said spoke-traversing crosspasses; a ring-traversing crosspass segment providing a passage between the inside and the outside of said ring-road interchange; an inner connecting segment connecting the inside of said ring-traversing crosspass segment to the ring-road interchange.

BRIEF DESCRIPTION OF THE DRAWINGS

For a better understanding of the invention and to show how it may be carried in practice, reference will now be made, purely by way of a non-limiting example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice. In the accompanying drawings.

DETAILED DESCRIPTION

Figure 1:
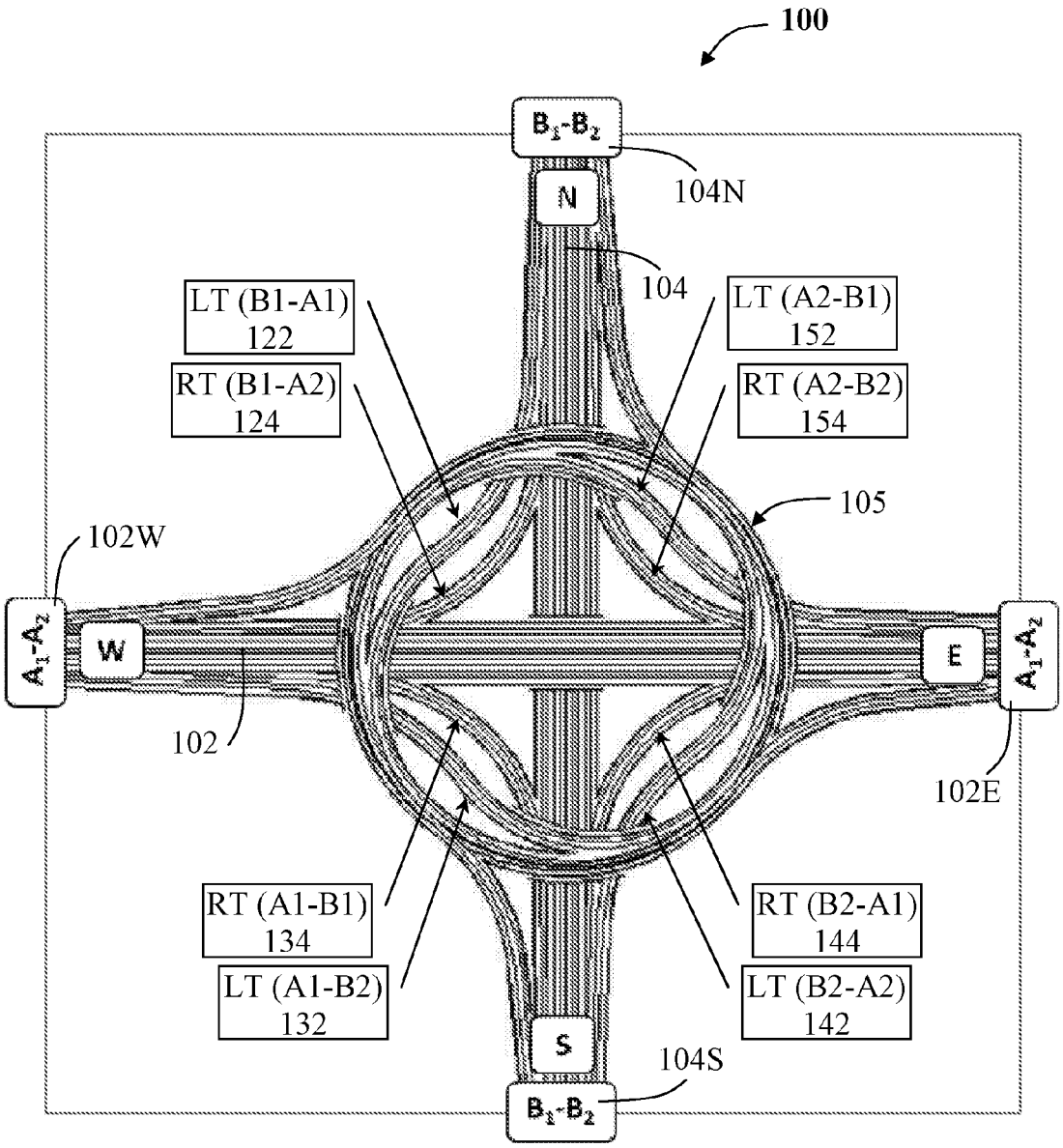
FIG. 1 is a schematic general top-view of a four-way road junction embodiment, type for an RHT driving system.

Aspects of the present disclosure relate to a spiral road junction system for connecting a plurality of highway spokes via various connecting road segments including cross-over connecting roads via a ring-road interchange providing continuous dedicated paths for smooth and safe traffic flow from entry spokes to exit spokes, avoiding possible conflict regions, such that no weaving occurs.

The spiral road junction system provides for direct access from an inbound section of a highway spoke to an outbound section of another highway spoke via the ring-road interchange, where the ring-road interchange provides a continuous ring road traversing a plurality of spoke-traversing crosspasses, each spoke-traversing crosspass traversing a highway spoke. The junction may further provide another direct access adjacent-spoke connecting road from the inbound section to outbound sections of other highway spokes, possibly along the same level.

As used herein, the term "highway spoke" refers to a road connecting with a road junction and extending radially therefrom. For example, a continuous highway crossing a road junction may be described, where appropriate, as two highway spokes connected at the junction. Also, as used herein, the term "crosspass" refers to a segment of a first road which traverses a second road along a plane either above or below the second road. Examples of crosspasses include overpasses and underpasses such as bridges, tunnels, cuttings and the like.

Accordingly, the ring-road interchange may include multiple (N) crosspasses, each crosspass traversing a highway spoke. The spiral road junction may further include a cross-over connecting road for each highway spoke, comprising a slip road diverging from an inbound section of a first highway spoke and forming a continuous path converging with an access road to merge with an outbound section of the $N^{th}$ spoke.

Where appropriate, the continuous path may include a ring-road interchange segment, a crosspass road segment to provide passage between the inside and the outside of the ring-road interchange and an inner connecting segment, connecting the inside of the crosspass segment to the ring-road interchange.

Where appropriate, the inbound section of a first highway spoke may be connected directly via an adjacent-spoke connecting road to the outbound section of a second highway spoke and via the continuous path to the outbound section of a third highway spoke.

It is noted, where appropriate, that the adjacent-spoke connecting road segments may use a slip road to diverge from the inbound section of the highway spoke downstream, within the ring-road interchange. It is noted that such a configuration may allow the interchange to have a smaller area footprint. Further, such order of divergence may provide a 'no weaving' experience to a road user along the dedicated continuous path. Further, using of multi-lanes in every direction may provide for minimal loss of traffic effectiveness. Where required, the order of divergence may be adjusted to suit civil engineering, political, urban, commercial and other needs.

Additionally or alternatively, the continuous path via the ring-road interchange providing direct turns may support corrective maneuvers, correction of navigation errors such as performing about-turns, smoothly, and without weaving.

The current disclosure of a spiral road junction may suit various road junctions, such as the common three-way and four-way road junctions and may also be used in more complicated road systems such as five-way road junctions and six-ways as described hereinafter. Further, the current disclosure may answer the need for a right-hand traffic (RHT) driving system as accustomed in Europe, the US and the like, and for a left-hand traffic (LHT) driving system as accustomed in the UK, Japan and the like.

As used herein, the term "RHT" refers to a right-hand traffic driving system. Similarly, the term "LHT" refers to a left-hand traffic driving system. It is noted that the spiral road junction of the current disclosure, regardless of the driving system, may equally be applied mutatis mutandis to an RHT driving system and an LHT driving system.

The continuous path of the spiral road junction from an inbound section of a first spoke to an outbound section of another spoke, may be configured to follow two types of an outward spiral route or an inward spiral route, providing more flexibility to answer traffic demands and regulations and adjustments to area conditions.

Accordingly, as used herein, the term "outward spiral interchange" refers to an interchange system configured to provide a road user with at least one driving path converging with a ring-road interchange from the inside. Similarly, the term "inward spiral interchange" refers to an interchange system configured to provide a road user with a driving path converging with the ring-road interchange from the outside.

It is noted that the current disclosure teaches a method for constructing road junctions in relatively small areas. Further, the structural design provides excellent traffic conditions of high traffic capacity, high speed and many lanes in one direction, without the need of crossing between them, or reducing transportation effectiveness and correcting navigational errors.

By way of example, various embodiments are described below. It will be appreciated that other configurations of the junction may be constructed to suit requirements.

Four-Way Spiral Junction System

The following embodiments describe various aspects of a four-way spiral junction road for an RHT driving system such as accustomed in Europe, USA, Canada, China and other countries and for an LHT driving system such as accustomed in the UK, Japan, Australia and other countries.

The four-way spiral road junction system, as described hereinafter, connects four highway spokes, each identified by a road number and a directional letter of N (North), S (South), E (East) or W (West). It will be appreciated that these directional labels are provided for convenience only, the actual geographical orientation of the junction being entirely arbitrary. Further, each highway spoke includes an inbound section having at least one inbound lane and an outbound section having at least one outbound lane.

Reference is now made to FIG. 1, showing a schematic general top-view 100 of a four-way spiral road junction embodiment of an "outward spiral interchange" type for a RHT driving system.

It is noted that the general top-view 100 represents, by way of example, an "outward spiral interchange" type for an RHT driving system. Other equivalent interchange types may be considered such as "inward spiral interchange" type for an RHT driving system, an "outward spiral interchange" type for a LHT driving system or an "inward spiral interchange" type for an LHT driving system.

The general top-view 100 of the four-way spiral road junction includes an east-west highway road 102 comprising an east highway spoke 102E and a west highway spoke 102W, intersecting a north-south highway road 104 comprising a north highway spoke 104N and a south highway spoke 104S, an upper continuous ring-shaped road surface 105 providing a ring-road interchange and a road system to allow leaving an inbound section of an associated entry highway spoke and joining an outbound section of another exit highway spoke.

It is noted that the road system and structural road segments required to allow the desired traffic flow are described in detail in FIG. 4, hereinafter.

The general top-view 100 further illustrates the various possible right and left turns as configured via the four-way spiral road junction.

Direct Cross-Over Left Turns:

Left turn 122 from inbound section B1 of north highway spoke 104N to outbound section A1 of east highway spoke 102E.

Left turn 132 from inbound section A1 of west highway spoke 102W to outbound section B2 of north highway spoke 104N.

Left turn 142 from inbound section B2 of south highway spoke 104S to outbound section A2 of west highway spoke 102W.

Left turn 152 from inbound section A2 of east highway spoke 102E to outbound section B1 of south highway spoke 104S.

It is noted that all the above-listed turns are enabled by crossover connecting roads which include at least one cross-pass traversing the continuation of the road from which the crossover connecting road has diverged.

Direct Right Turns:

Right turn 124 from inbound section B1 of north highway spoke 104N to outbound section A2 of west highway spoke 102W.

Right turn 134 from inbound section A1 of west highway spoke 102W to outbound section B1 of south highway spoke 104S.

Right turn 144 from inbound section B2 of south highway spoke 104S to outbound section A1 of east highway spoke 102E.

Right turn 154 from inbound section A2 of east highway spoke 102E to outbound section B2 of north highway spoke 104N.

Figure 2A:
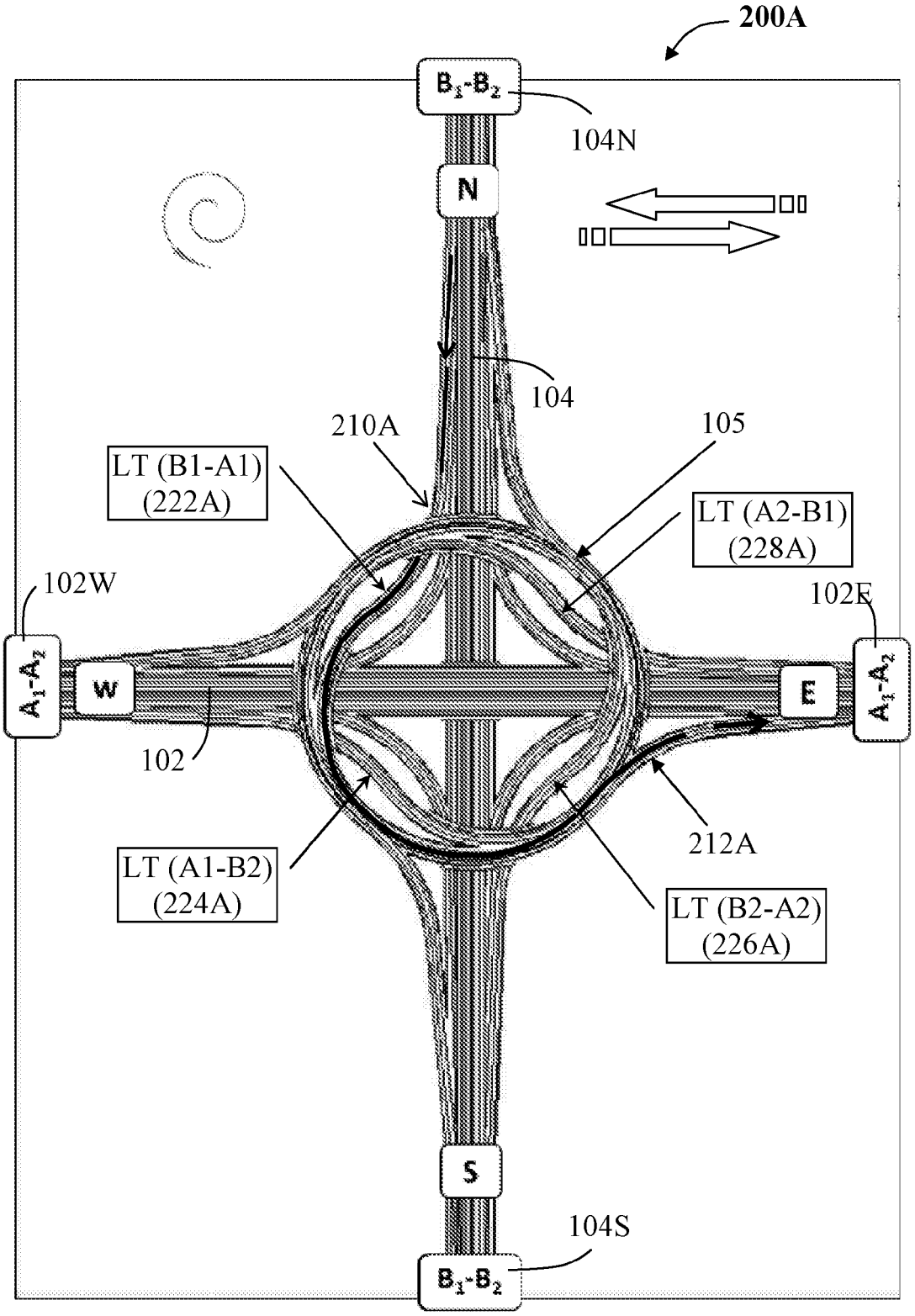
FIGS. 2A-B are a schematic top view representations of possible left turns in a four-way spiral road junction embodiment of an outward and inward spiral interchange type for an RHT driving system.

Reference is now made to FIG. 2A, showing a schematic top-view 200A representation of possible left turns in a four-way road junction embodiment of an "outward spiral interchange" type for an RHT driving system.

The schematic top-view 200A includes continuous paths of left turn representations 222A, 224A, 226A and 228A, each left turn is associated with an entry highway spoke and an exit highway spoke, as detailed in FIG. 1, hereinbefore. For example, the specific associated continuous path, as indicated by the arrowed path, leaves the inbound section B1 of entry highway spoke 104N via slip road 210A, cross-passes through road segments to pass under the upper ring-road interchange 105 link with the ring-road interchange from the inside, and further joins the outbound section A1 of the exit highway spoke 102E, via the access road 212A from the outside, thus, allowing the desired continuous path.

It is noted that the described structural references of the embodiment refer to a landscape having a flat topography. Other types of landscape may change the structural elements accordingly.

Figure 4:
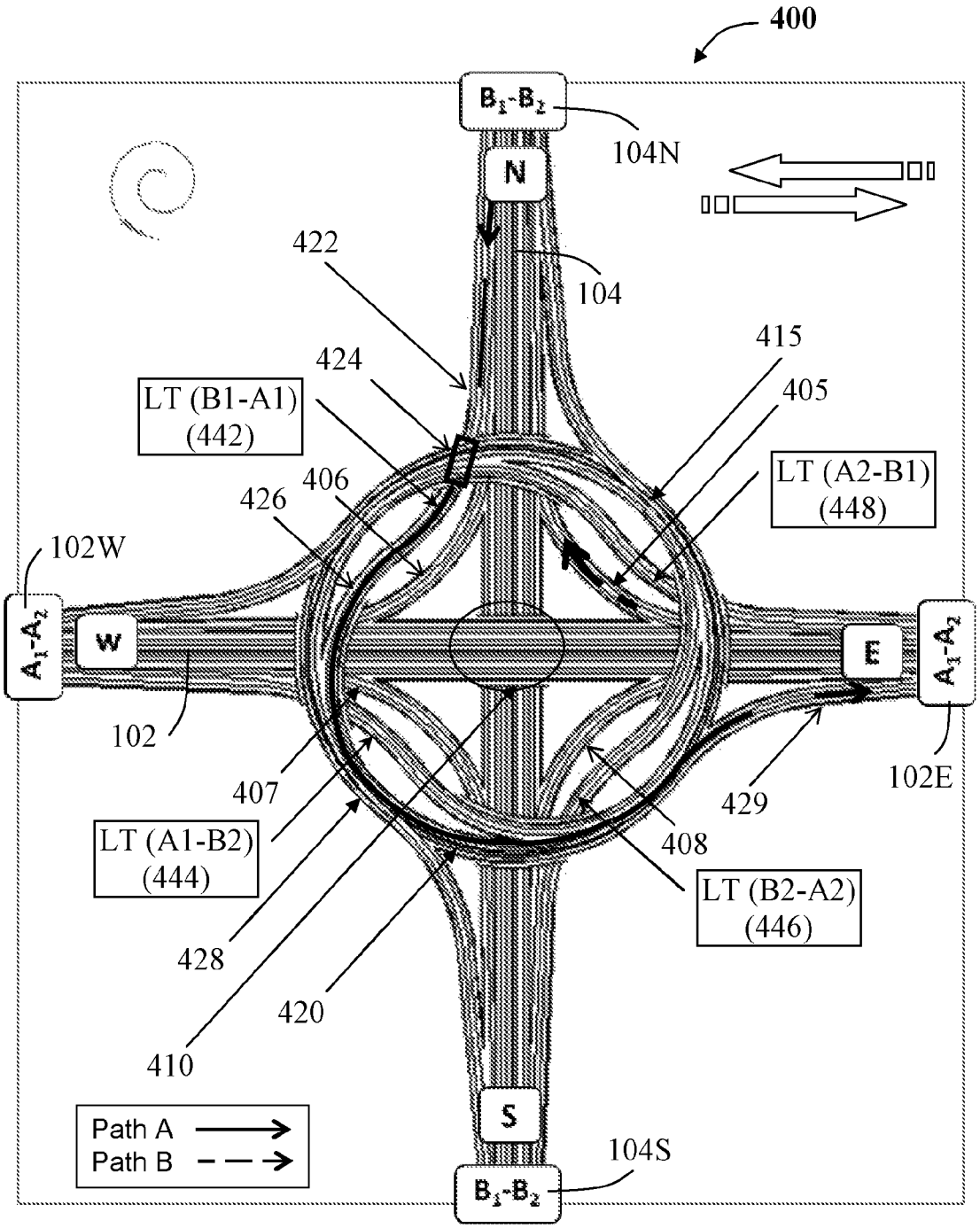
FIG. 4 is a schematic structural embodiment of a four-way spiral road junction embodiment of an "outward spiral interchange" type for an RHT driving system.

It is further noted that the road system and structural road segments required to allow the desired traffic are detailed in FIG. 4.

Figure 2B:
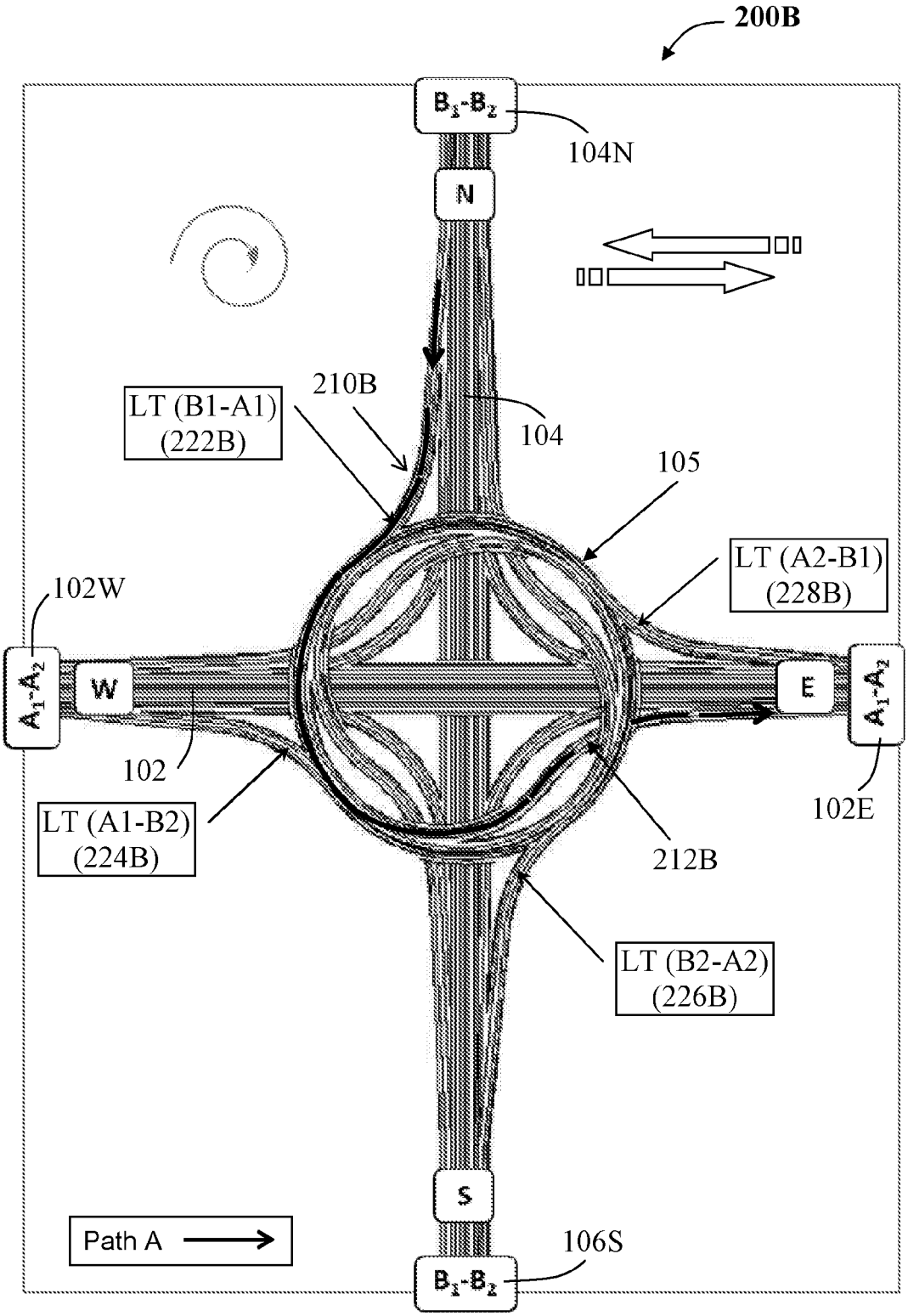
Figure 3A:
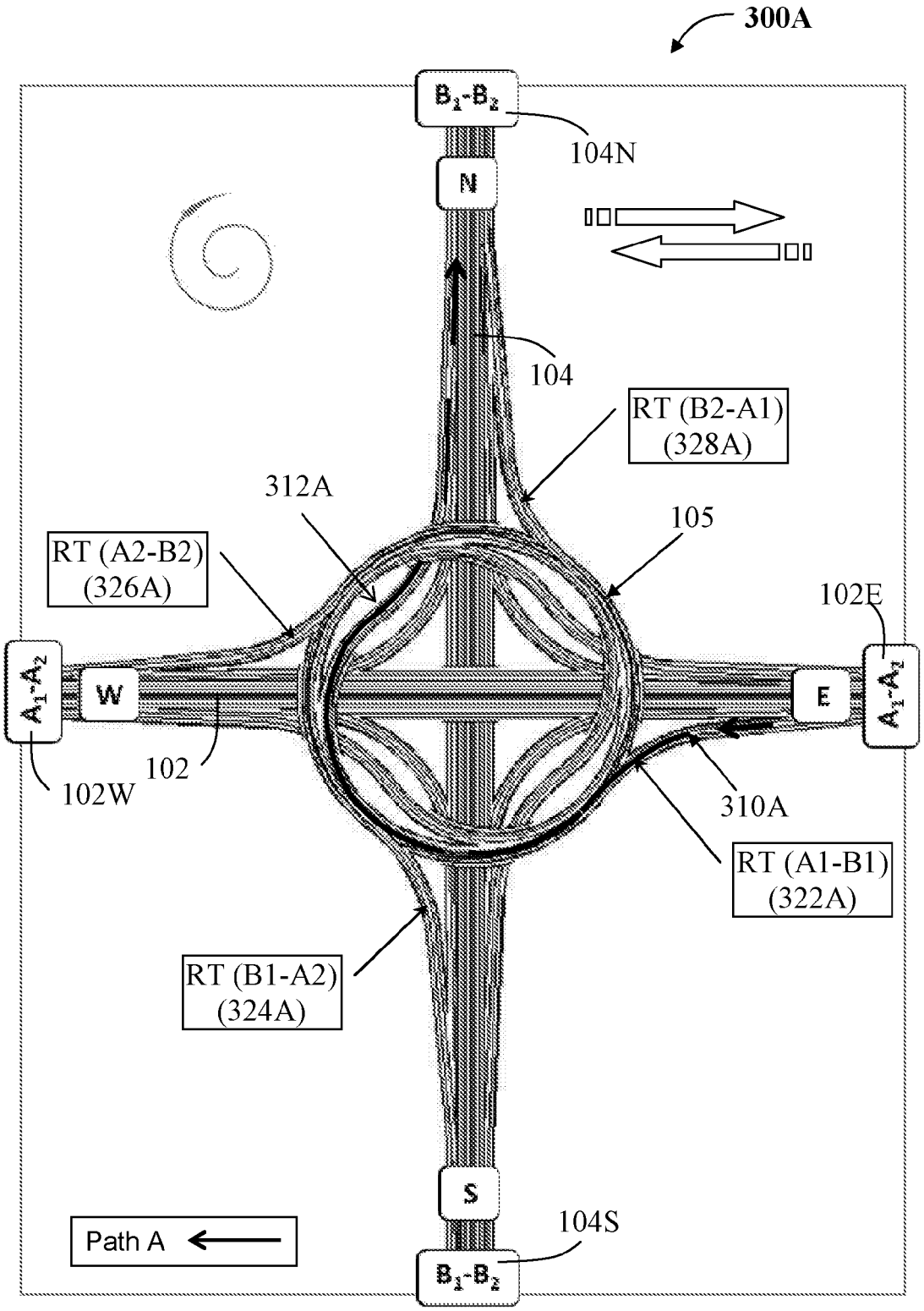
FIGS. 3A-B are a schematic top view representation of possible right turns in a four way spiral road junction embodiment of an outward and inward spiral interchange type for an LHT driving system.
Figure 3B:
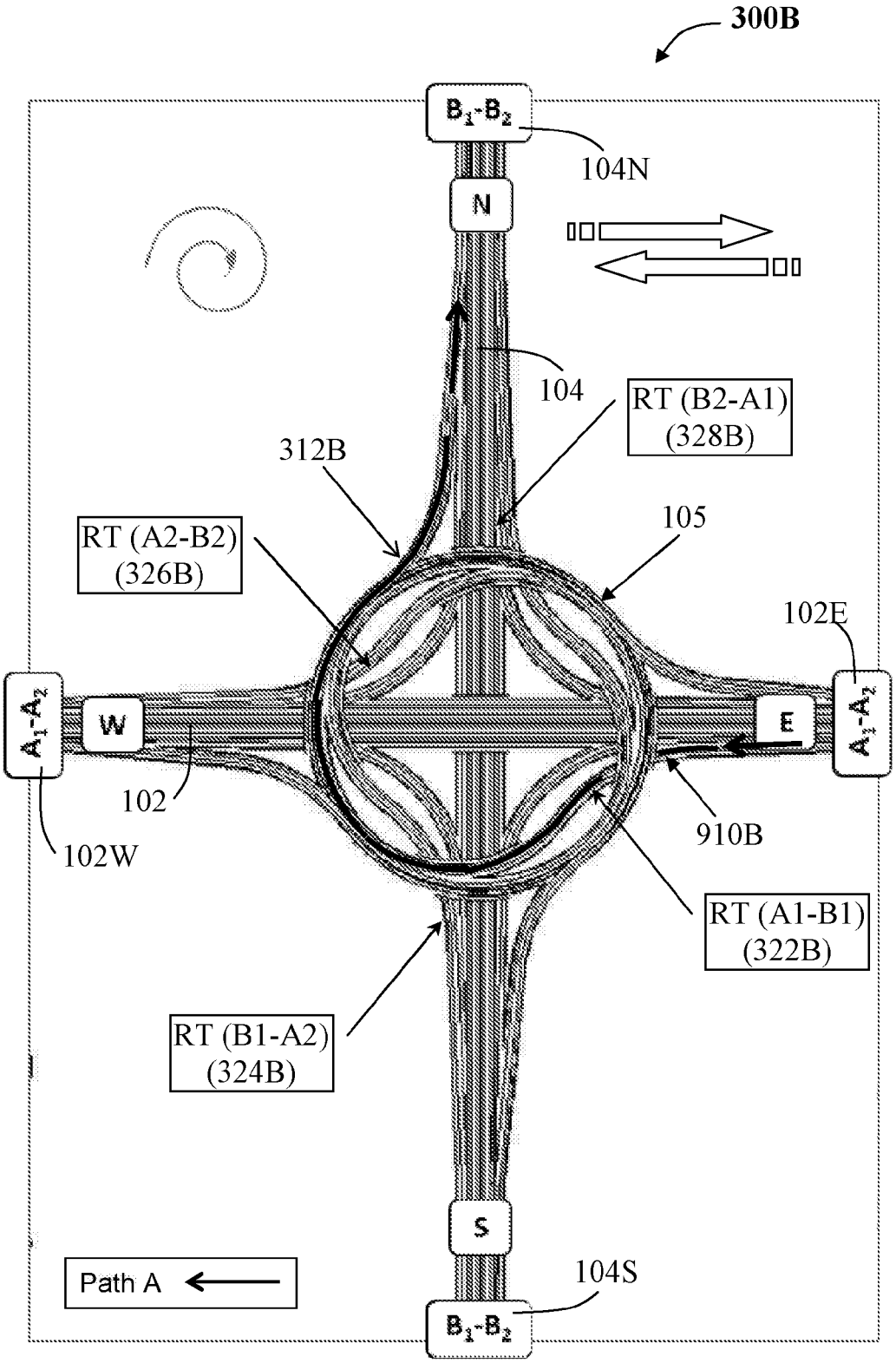

Accordingly FIG. 2B shows a schematic representation of possible left turns, as indicated in FIG. 1, and an example of a dedicated continuous path for a four-way RHT spiral interchange "inward spiral interchange" type. Further, FIGS. 3A and 3B show schematic representations of possible right turns and additional dedicated continuous paths for a four-way LHT spiral interchange, where FIG. 3A refers to an "outward spiral interchange" type and FIG. 3B refers to an "inward spiral interchange" type.

Reference is now made to FIG. 4, a top view of a four-way spiral road junction showing a possible structural embodiment 400 of an "outward spiral interchange" type for an RHT driving system.

The structural embodiment 400 of the four-way spiral road junction includes a highway spoke 102W having an inbound section A1 and an outbound section A2; a highway spoke 102E having an inbound section A2 and an outbound section A1; a highway spoke 104N having an inbound section B1 and an outbound section B2 and highway spoke 104S having an inbound section B2 and an outbound section B1; a flyover intersection crosspass 410; a cross-over connecting road associated with each highway spoke, as described hereinafter; and a ring-road interchange 415 comprising four crosspasses providing a continuous path for each highway spoke, as exemplified by the continuous path 420 allowing a left turn, as described hereinafter.

The spiral road junction 400 further includes a ring-road interchange 415 comprising a plurality of spoke-traversing crosspasses where each crosspass traverses a highway spoke.

The cross-over connecting road, providing a left turn 442 (B1-A1), is exemplified by the continuous path 420, associated with entry highway spoke 104N and exit highway spoke 102E, includes a slip road 422 providing access from the inbound section B1 of entry highway spoke 104N, a ring-traversing crosspass segment 424, an inner connecting segment 426, a ring-road interchange spiral segment 428 and access road 429 providing access to exit highway spoke 102E. As appropriate, the left turn path 442 (B1-A1), is leaving the at least one outbound lane of the inbound section B1 of entry highway spoke 104N to join the at least one outbound lane of the outbound section A1 of exit highway spoke 102E.

It is noted that the ring-road interchange segment 428 may traverse all intermediate highway spokes between an entry highway spoke and an exit highway spoke. Further, the ring-traversing crosspass segment 424 provides a passage between the inside and the outside of the ring-road interchange 415.

Similarly, there may exist a dedicated continuous path for a left turn path 444 (A1-B2) from entry highway spoke 102W to exit highway spoke 104N along a path leaving the at least one inbound lane of inbound section A1 of the entry highway spoke 102W to join the at least one outbound lane of outbound section B2 of the exit highway spoke 104N; a dedicated continuous path for a left turn path 446 (B2-A2) from entry highway spoke 104S to exit highway spoke 102W along a path leaving the at least one inbound lane of inbound section B2 of the entry highway spoke 104S to join the at least one outbound lane of outbound section A2 of the exit highway spoke 102W; and a dedicated continuous path for a left turn path 448 (A2-B1) from entry highway spoke 102E to exit highway spoke 104S along a path leaving the at least one inbound lane of inbound section A2 of the entry highway spoke 102E to join the at least one outbound lane of outbound section B1 of the exit highway spoke 104S.

Additionally, the direct paths for right turns may be operable to use an adjacent-spoke connecting road 405 to turn right from highway spoke 102E to highway spoke 104N, an adjacent-spoke connecting road 406 to turn right from highway spoke 104N to highway spoke 102W, an adjacent-spoke connecting road 407 to turn right from highway spoke 102W to highway spoke 104S and an adjacent-spoke connecting road 408 to turn right from highway spoke 104S to highway spoke 102E. Thus, the adjacent-spoke connecting paths are configured to leave at least one inbound lane of inbound section A2 of the highway spoke 102E to join the at least one outbound lane of outbound section B2 of highway 104N; leave the at least one inbound lane of inbound section B1 of highway spoke 104N to join the at least one outbound lane of outbound section A2 of highway 102W; leave the at least one inbound lane of inbound section A1 of highway spoke 102W to join the at least one outbound lane of outbound section B1 of highway 104S; and leave the at least one inbound lane of the inbound section B2 of highway spoke 104S to join the at least one outbound lane of the outbound section A1 of the highway spoke 102E.

It is noted that the ring-road interchange 415 of the four-way spiral road junction 400 of the "outward spiral interchange" type is configured to cross-over the slip road 422. Further, the inner connecting segment 426 is configured to connect the ring-road interchange segment 428 from the inside, providing a continuous path to allow traffic to flow continuously, without any lane intersection, thus, avoiding any traffic lights, ramps and the like. Further, as the left direct turns are accessible upstream to the right direct turns, the structural area is kept to a minimum and may answer various commercial or urban needs.

It is particularly noted that at least one adjacent-spoke connecting road may be disposed within the area contained within the ring-road interchange 415, such as indicated by the adjacent-spoke connecting segments 405, 406, 407 and 408.

The flyover intersection crosspass 410 may comprise a first link road connecting highway spoke 102W and highway spoke 102E and a second link road connecting highway spoke 104N and highway spoke 104S, where the first link road traverses the second link road via the flyover intersection crosspass, thus, the first link road may run, for example, half level under-ground, while the second link road may run at half level above-ground. Accordingly, the flyover intersection crosspass may be a bridge, a tunnel, a cutting or a combination thereof.

Where appropriate, the spiral road junction 400 allows for corrections and about-turns, as described hereinafter.

Optionally, the ring-road interchange 415 of the spiral road junction provides for a continuous crosspass on one level.

Figure 5A:
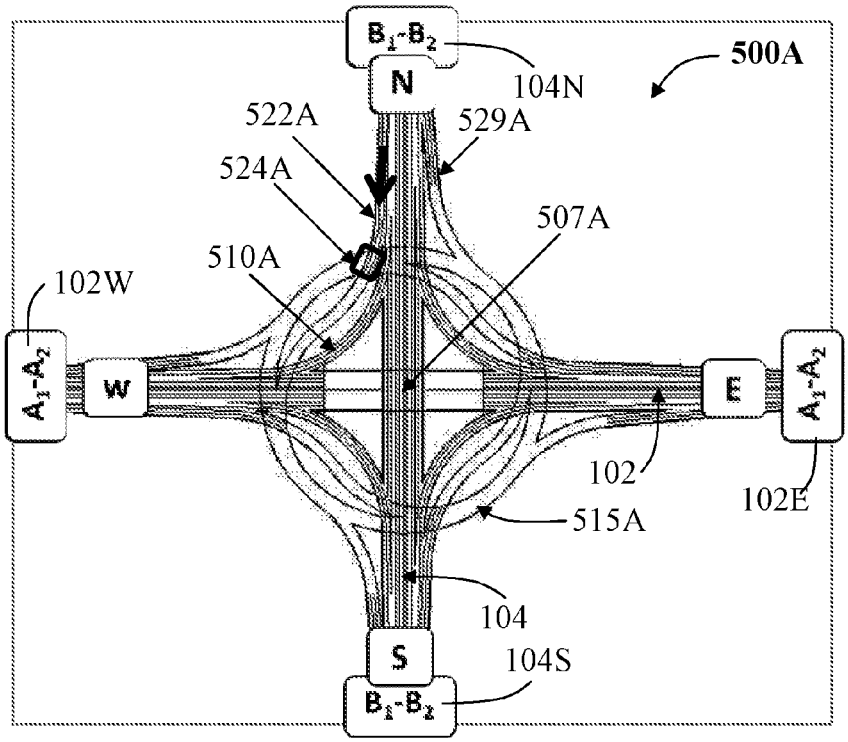
FIGS. 5A-B are schematic representations of the lower and upper level road system embodiment of a four-way spiral road junction of an outward and inward spiral interchange type for an RHT driving system.
Figure 5B:
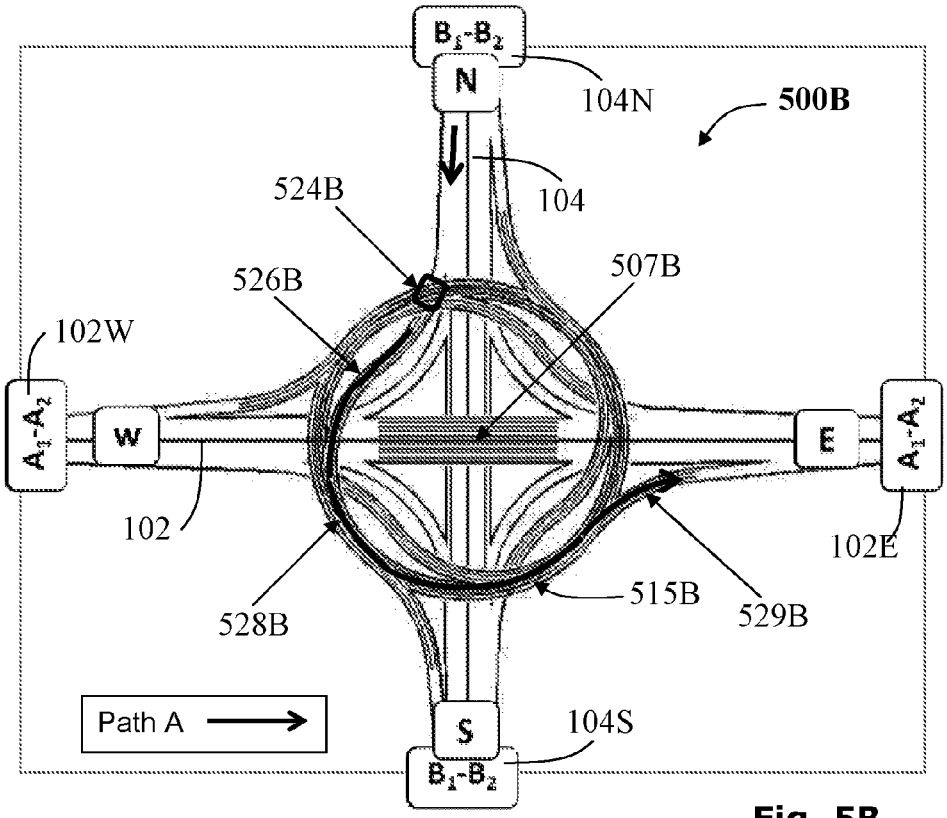

Road System—Lower/Upper Level:

FIGS. 5A-B illustrate the road system of a four-way spiral road junction of the "outward spiral interchange" type, showing the lower and upper levels, separately. FIG. 5A shows, schematically, the lower level road system and FIG. 5B shows, schematically, the elevated road system.

Reference is now made to FIG. 5A, showing a schematic representation of the lower level road system 500A of a four-way road junction of an "outward spiral interchange" type for an RHT driving system.

The lower level road system 500A includes the roads configured to allow traffic via the various highway spokes, connecting the spiral road junction 515A with an inbound section and an outbound section of each highway spoke at the lower level; an outbound section A1 and an inbound section A2 associated with east highway spoke 102E; an inbound section A1 and an outbound section A2 associated with west highway spoke 102W; an inbound section B1 and an outbound section B2 associated with north highway spoke 104N; and an inbound section B2 and an outbound section B1 associated with south highway spoke 104S.

Referring to highway spoke 104N, the lower level road system 500A includes a slip road 522A associated with the inbound section B1 and a ring-traversing crosspass segment 524A to provide access to the elevated ring-road interchange 515A (via an inner connecting segment 526B, FIG. 5B); a slip road 529A associated with outbound section B2 entry for completion of left turns or about-turns; an adjacent-spoke connecting road 510A allowing right turns from the inbound section B1 of highway spoke 104N to the outbound section A2 of highway spoke 102W; a road segment 507A to allow traffic flow at the intersection of highway road 102 and highway road 104.

It is noted that in dense areas, the main roads of the lower level road system may be designed to drop half a level and the elevated level road system may be designed to rise half a level, thus consuming only half the length of road sections needed within the ring.

It is further noted that similar/identical structures may exist for highway spoke 104S; highway spoke 102E and highway spoke 102W.

Reference is now made to FIG. 5B, showing a schematic representation of an elevated road system 500B of a four-way road junction of an "outward spiral interchange" type for an RHT driving system.

The elevated road system 500B includes the roads configured to connect the spiral road junction 515B, at the elevated level, with an inbound section and an outbound section, of each highway spoke; an outbound section A1 and an inbound section A2 associated with east highway spoke 102E; an inbound section A1 and an outbound section A2 associated with west highway spoke 102W; an outbound section B1 and an inbound section B2 associated with north highway spoke 104N; and an inbound section B2 and an outbound section B1 associated with south highway spoke 104S.

Referring to highway spoke 104N, the elevated level road system 500B includes a ring-traversing crosspass segment 524B associated with the inbound section B1 to provide access to the elevated continuous ring-shaped road surface 515B of the ring-road interchange via the slip road 522A (FIG. 5A), an inner connecting segment 526B, a ring-road interchange spiral segment 528B and an upper slip road segment 529B to allow joining the outbound section A1 of highway spoke 102E; and a road segment 507B associated with highway 102 to allow traffic at the point of intersection with highway road 104 with no traffic lights.

It is noted that similar/identical structure may exist (not numbered) for highway spoke 104S; highway spoke 102E and highway spoke 102W.

Figure 6A:
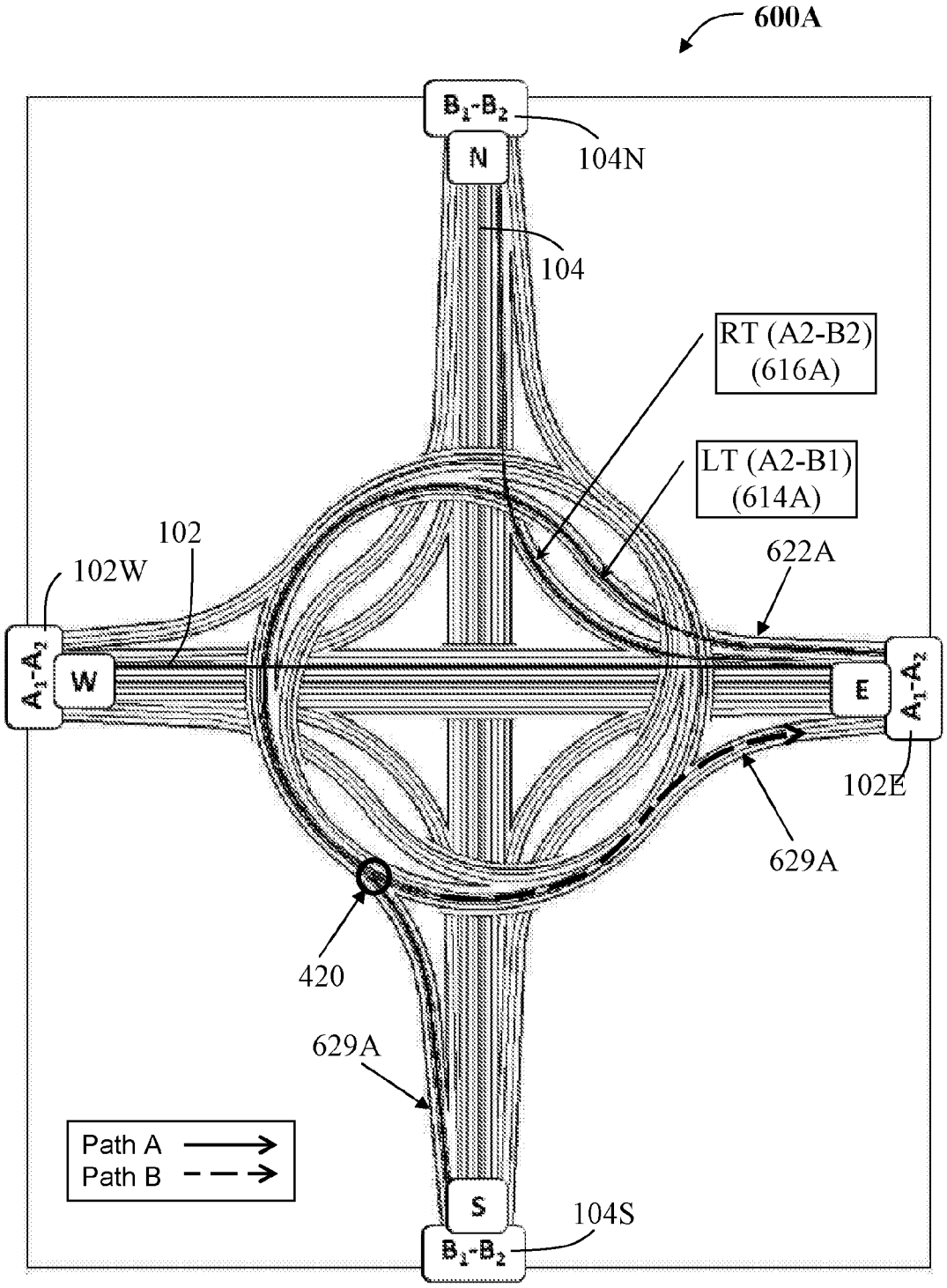
FIGS. 6A-C are schematic representations of possible driving options from an highway spoke, free passage and correction section enlargement in a four-way road junction embodiment of an "outward spiral interchange" type for an RHT driving system.

Traffic Flow and Corrections:

Reference is now made to FIG. 6A, showing a schematic view of a four-way road junction 600A indicating possible driving options from a highway spoke of an "outward spiral interchange" type for an RHT driving system.

The four-way road junction 600A includes an entry highway spoke 102E having an inbound section A2 and an outbound section A1; an inbound slip road 622A diverging from the entry highway spoke 102E and an outbound access road 629A converging with an exit highway spoke 104S, allowing a left turn 614A via the inbound slip road 622A to join the outbound section B1 of the exit highway spoke 104S via the access road 629A. An adjacent-spoke connecting road 616A enables a direct right turn to join the outbound section B2 of the highway spoke 104N.

It is noted that a continuous path A, representing the left turn 614A, may enable a change of direction at the correction region 420, to allow a correction such as performing an about-turn, instead of completing the initial left turn 614A, as indicated by the arrowed path B. Moving to the correction region brings the road user, initially, to a lane with no interfering with the normal traffic flow along the ring-shaped path due to the free space left between the spiral structure and the ring-road interchange.

It is further noted that similar driving options are available for each one of the other highway spokes of the spiral road junction.

Figure 6B:
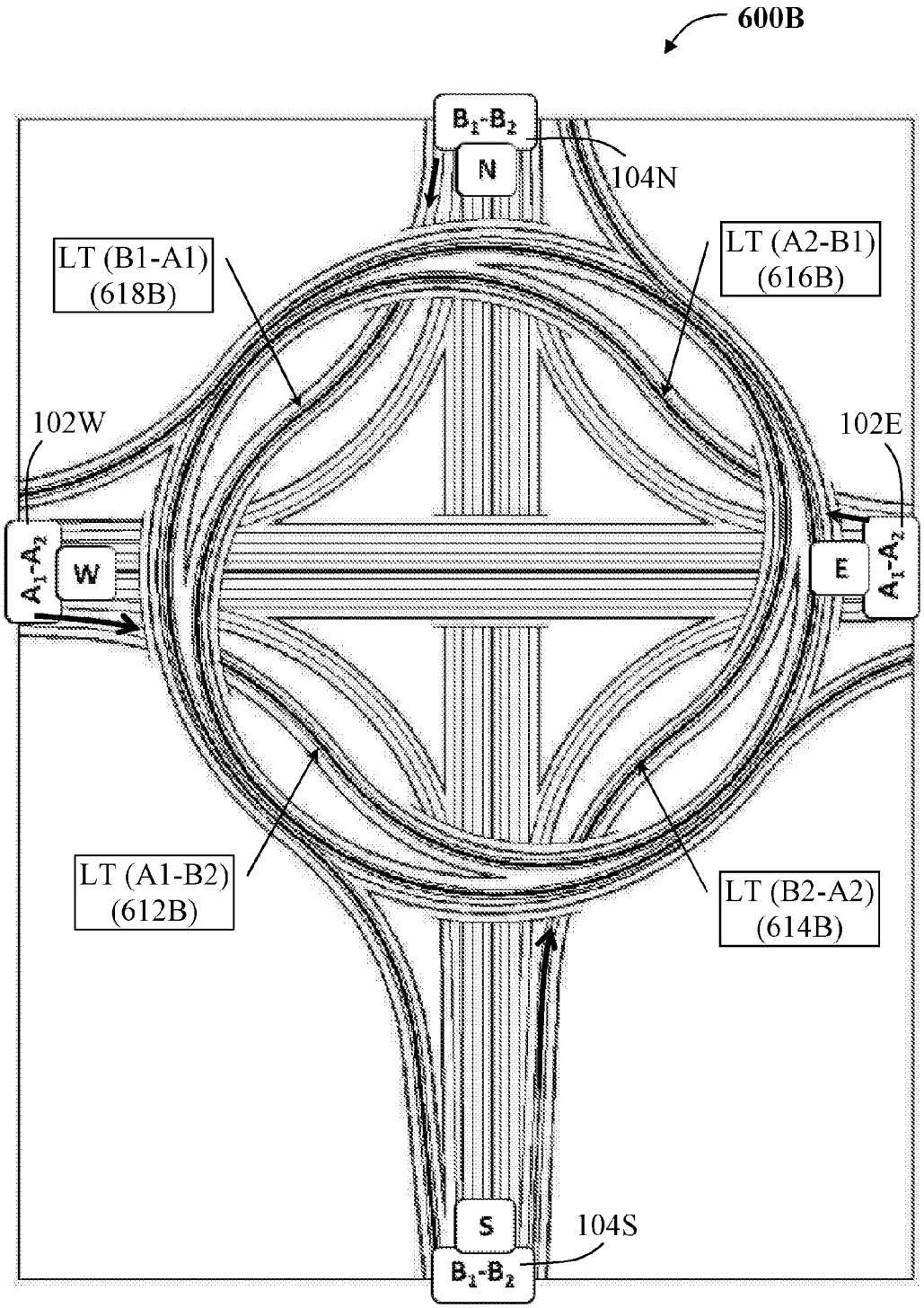

Reference is now made to FIG. 6B, showing a schematic representation of the four-way road junction 600B indicating various free passage options in an "outward spiral interchange" type for an RHT driving system.

The schematic representation 600B includes a left turn 612B from inbound section A1 of a first entry highway spoke 102W to outbound section B2 of a first exit highway spoke 104N; a left turn 614B from inbound section B2 of a second entry highway spoke 104S to outbound section A2 of a second exit highway spoke 102W; a left turn 616B from inbound section A2 of a third entry highway spoke 102E to outbound section B1 of a third exit highway spoke 104S; and a left turn 618B from inbound section B1 of a fourth entry highway spoke 104N to outbound section A1 of a fourth exit highway spoke 102E.

It is noted that all the above free passage paths from all entry highway spokes to all exit highway spokes are fully dedicated to the specific traffic left or right turns, with no need for inter-crossing lanes, thus preventing the need for traffic weaving. Further, there is no need to change lanes, while turning.

Figure 6C:
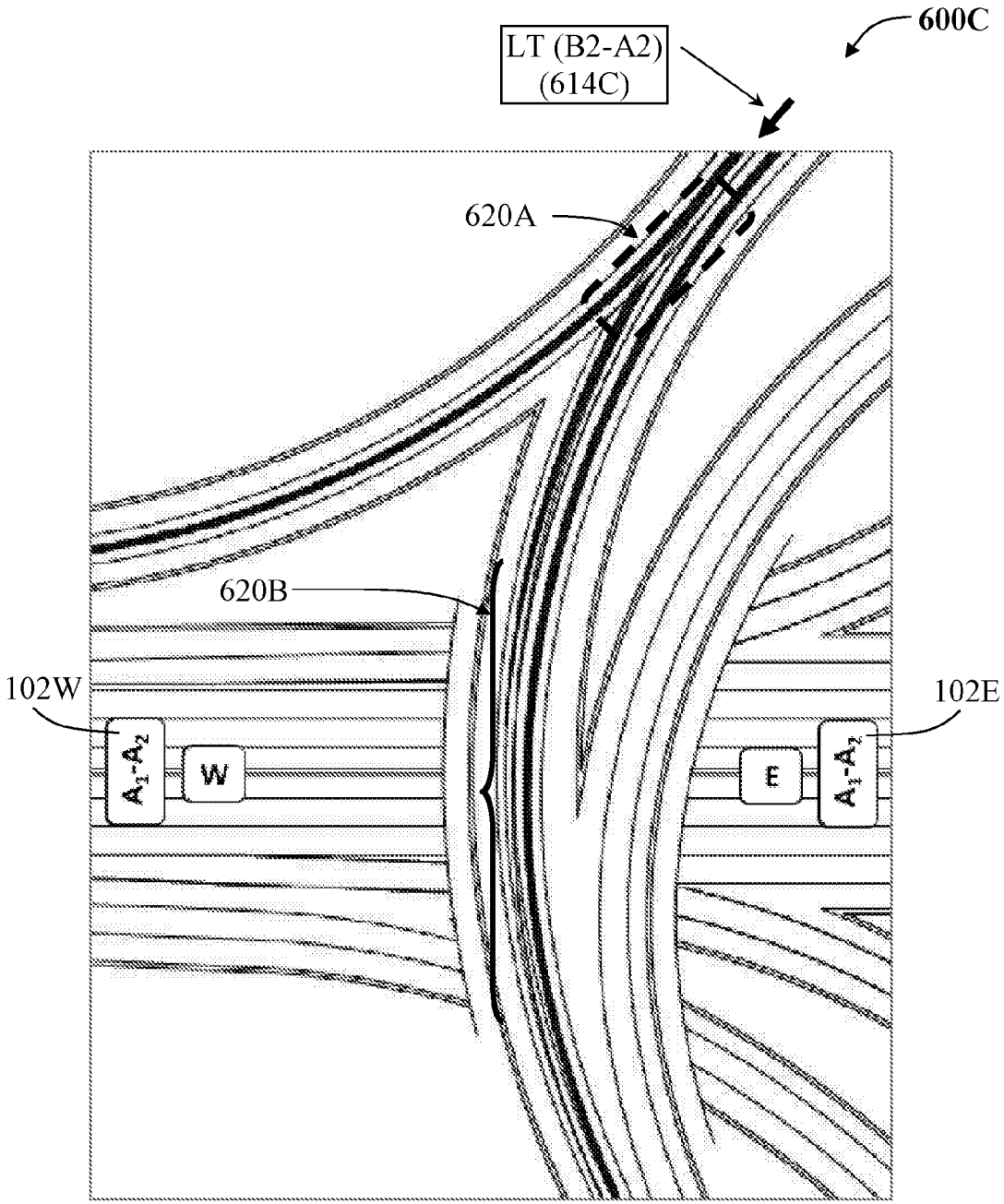

Reference is now made to FIG. 6C, showing a schematic representation 600C of about-turns and driving option corrections in a four-way road junction embodiment of an "outward spiral interchange" type for an RHT driving system.

The schematic representation 600C includes a left turn 614C from inbound section B2 of entry highway spoke 102S to outbound section A2 of exit highway spoke 104W.

The two correction regions, a diverging region 620A and a converging region 620B allow changes to a previous driving intention, for example when performing an about-turn. At the diverging region 620A, a driver may leave the previous path and at the converging region 620B the driver may rejoin ring-road interchange via a free merging area.

Figure 7:
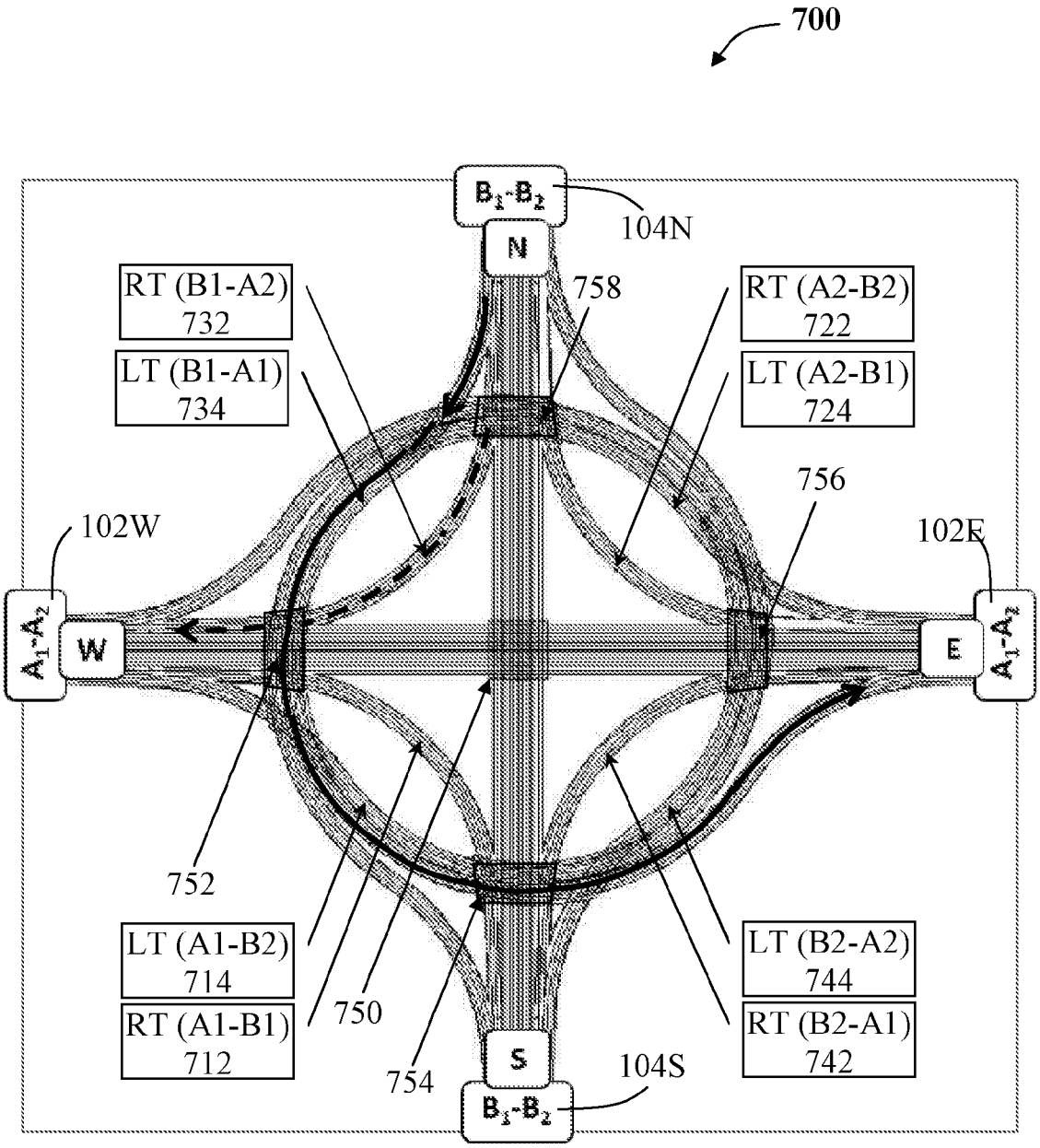
FIG. 7 is a schematic top-view representation of a multi-lane in a four-way road junction embodiment of an "outward spiral interchange" type for an RHT driving system.

Reference is now made to FIG. 7, showing a schematic top view of a multi-lane in a four-way spiral road junction embodiment of an "outward spiral interchange" type for an RHT driving system 700.

The four-way spiral road junction 700 includes a first highway spoke 102E having an inbound section A1 and an outbound section A2; a second highway spoke 102W having an inbound section A2 and an outbound section A1; a third highway spoke 104N having an inbound section B1 and an outbound section B2; and a fourth highway spoke 104W having an inbound section B2 and an outbound section B1;

The multi-lane top view of the four-way spiral road junction 700 includes four possible left turns and four possible right turns, as indicated above. The four-way spiral road junction 700 further includes a flyover intersection crosspass 750, a first spoke-traversing crosspass 752 associated with the first highway spoke 102E, a second spoke-traversing crosspass 754 associated with highway the second highway spoke 102W, a third spoke-traversing crosspass 756 associated with the third highway spoke 104N and a fourth spoke-traversing crosspass 758 associated with the fourth highway spoke 104W.

It is noted that due to the nature of a left turn in an RHT driving system, the continuous path for the left turn may include parallel adjacent lanes without the need for weaving. Optionally, different number of lanes may be used as suits the anticipated traffic volume without disrupting the continuous traffic flow.

Six-Way Spiral Junction System

The following embodiments describe various aspects of a six-way spiral junction road for an RHT driving system and for an LHT driving system.

The six-way spiral road junction system, as described hereinafter, connecting six highway spokes, each highway spoke is identified by a road number and directional labels of N (North), S (South), NE (North-East) and NW (North-West), SE (South-East) and SW (South-West). It will be appreciated that these directional labels are provided for convenience only, the actual geographical orientation of the junction being entirely arbitrary. Further, each highway spoke includes an inbound section having at least one inbound lane and an outbound section having at least one outbound lane.

Figure 8A:
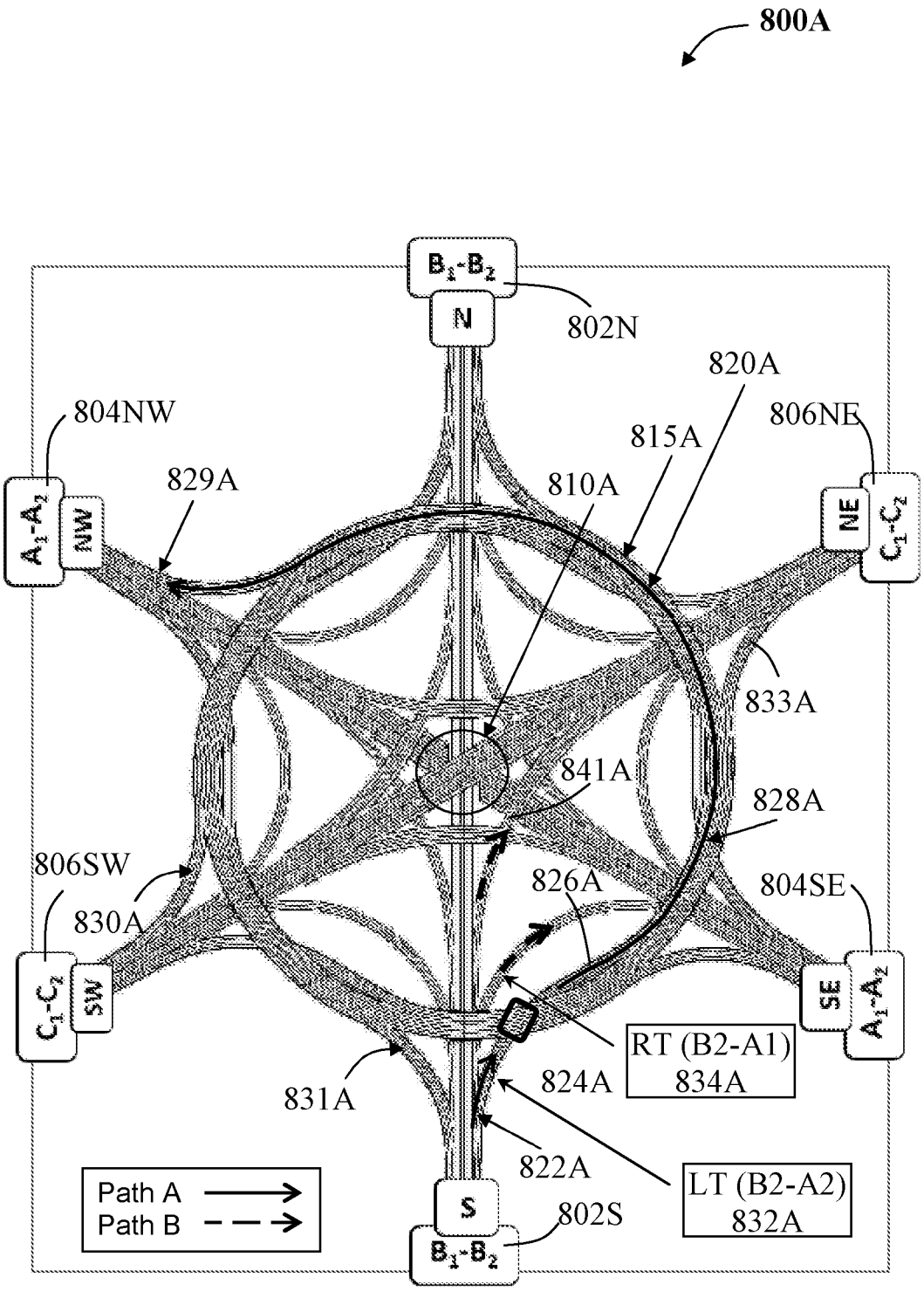
FIGS. 8A-F are schematic top-view representations of a six-way spiral road junction embodiment of an outward and inward spiral interchange type for an RHT and an LHT driving systems.

Reference is now made to FIG. 8A, showing a schematic top-view of a six-way road junction 800A of an "outward spiral interchange" type for an RHT driving system.

The schematic top-view 800A embodiment of the six-way spiral road junction includes a first highway spoke 802N having an inbound section B1 and an outbound section B2; a second highway spoke 802S having an inbound section B2 and an outbound section B1; a third highway spoke 804NE having an inbound section C2 and an outbound section C1; a fourth highway spoke 804SW having an inbound section C2 and an outbound section C1; a fifth highway spoke 806SE having an inbound section A2 and an outbound section A1; and a sixth highway spoke 806NW having an inbound section A1 and an outbound section A2; a flyover intersection crosspass 810A; a cross-over connecting road associated with each highway spoke, as described hereinafter; and a continuous ring-shaped road surface 815A providing a ring-road interchange comprising at least six crosspasses. It is noted that the ring-road interchange may provide a continuous path from each inbound highway spoke to each outbound highway spoke, as exemplified by the continuous path 820A allowing a left turn as described hereinafter.

The six-way road junction 800A includes a ring-shaped road surface 815A comprising six spoke-traversing crosspasses where each said crosspass traverses a highway spoke.

One cross-over connecting road, allowing a left turn 832 (B2-A2) is exemplified by the continuous path 820A from an entry highway spoke 802S to an exit highway spoke 804NW. The continuous path 820A includes a slip road 822A providing access from the inbound section B2 of the entry highway spoke 802S, a ring-traversing crosspass segment 824A, an inner connecting segment 826A, a ring-road interchange spiral segment 828A and an access road 829A providing access to the exit highway spoke 804NW. As appropriate, a left turn path 832A (B2-A2), diverges from at least one inbound lane of the inbound section B2 of entry highway spoke 802S and converges with at least one outbound lane of the outbound section A2 of the exit highway spoke 802NW.

It is noted that the ring-road interchange segment 828A may traverse all intermediate highway spokes between an entry highway spoke and an exit highway spoke.

The ring-traversing crosspass segment 824A provides a passage between the inside and the outside of the ring-road interchange 815A.

Similarly, a continuous path may be provided for a further left turn of inbound section B2 of entry highway spoke 802S to outbound section C1 of exit highway section 806SW via access slip road 830A. Similarly again, a further continuous path may be provided enabling an about turn path from the inbound section B2 of entry highway spoke 802S to outbound section B1 of the same highway section 802S via access slip road 831A.

Additionally, right turns may be configured to use adjacent-spoke connecting roads, as indicated by the arrowed paths B providing two possible right turns: a right turn from inbound section B2 of highway spoke 802S to outbound section A1 of highway spoke 804SE and from inbound section B2 of highway spoke 802S to outbound section C1 of highway spoke 806NE.

It is noted that direct turns via a cross-over connecting road may use a slip road diverging from the inbound section upstream from the adjacent-spoke connecting road. This configuration may keep the structural area to a minimum and may answer various urban needs.

It is also noted that such a six-way structure may provide access to an exit highway spoke either via an adjacent-spoke connecting road or via a slip road through the ring-road interchange. For example two paths may be travelled from the inbound section B2 of entry highway spoke 802S to the outbound section C1 of exit highway spoke 806NE, either by (a) via the ring-road interchange 815A and exiting along the access road 833A or (b) via a secondary spoke-traversing link road 841A, providing flexibility throughout the design process of the spiral road junction.

Alternatively, the adjacent-spoke connecting roads or secondary spoke-traversing link roads may be removed, to enable the center area to be used for other environmental/commercial/urban needs.

The flyover intersection 810A may comprise primary link roads and secondary link roads. For example, a first primary link road connecting highway spoke 804NE and highway spoke 804SW; a second primary link road connecting highway spoke 806SE and highway spoke 806NW; and a third primary link road connecting highway spoke 802S and highway spoke 802N, where the first primary link road traverses the second link road via the flyover intersection crosspass and the second primary link road traversing the third primary link road via a second flyover intersection crosspass. Thus, the first primary link road may run, for example, one level under-ground, the second primary link road may run at ground level and the third primary link road may run at one level above-ground.

Furthermore, the flyover intersection 810A may comprise a plurality of secondary spoke-traversing link roads connecting non-adjacent pairs of highway spokes via crosspasses traversing intermediate link roads to provide direct paths from entry highway spokes to exit highway spokes.

Accordingly, the flyover intersection crosspass may be a bridge, a tunnel, a cutting or a combination thereof.

Where appropriate, the ring-road interchange 815A allows for corrections and about-turns, as described herein. Optionally, the ring-shaped road surface of the ring-road interchange 815A of the spiral road junction provides for a continuous crosspass on one level.

Figure 8B:
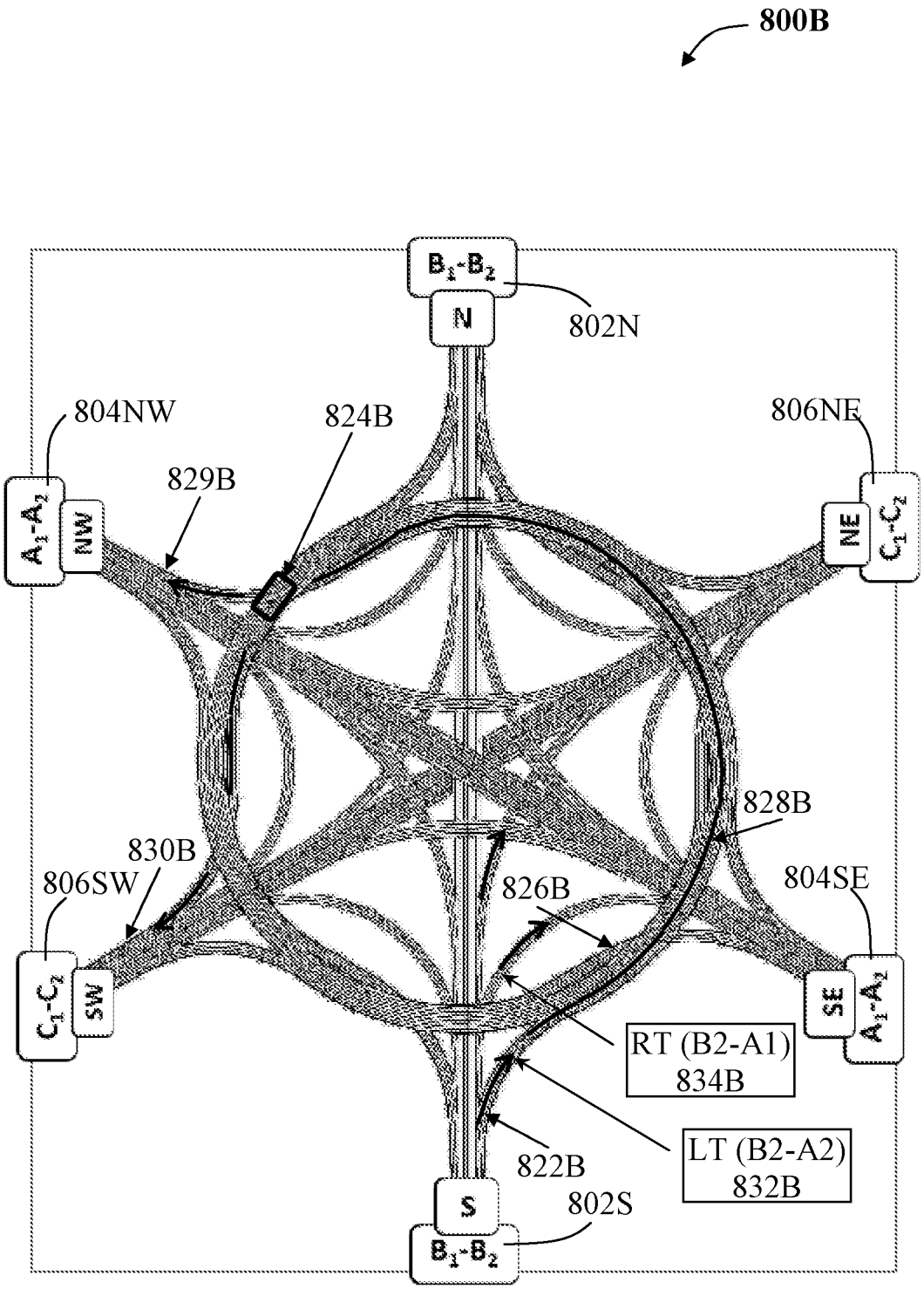
Figure 8C:
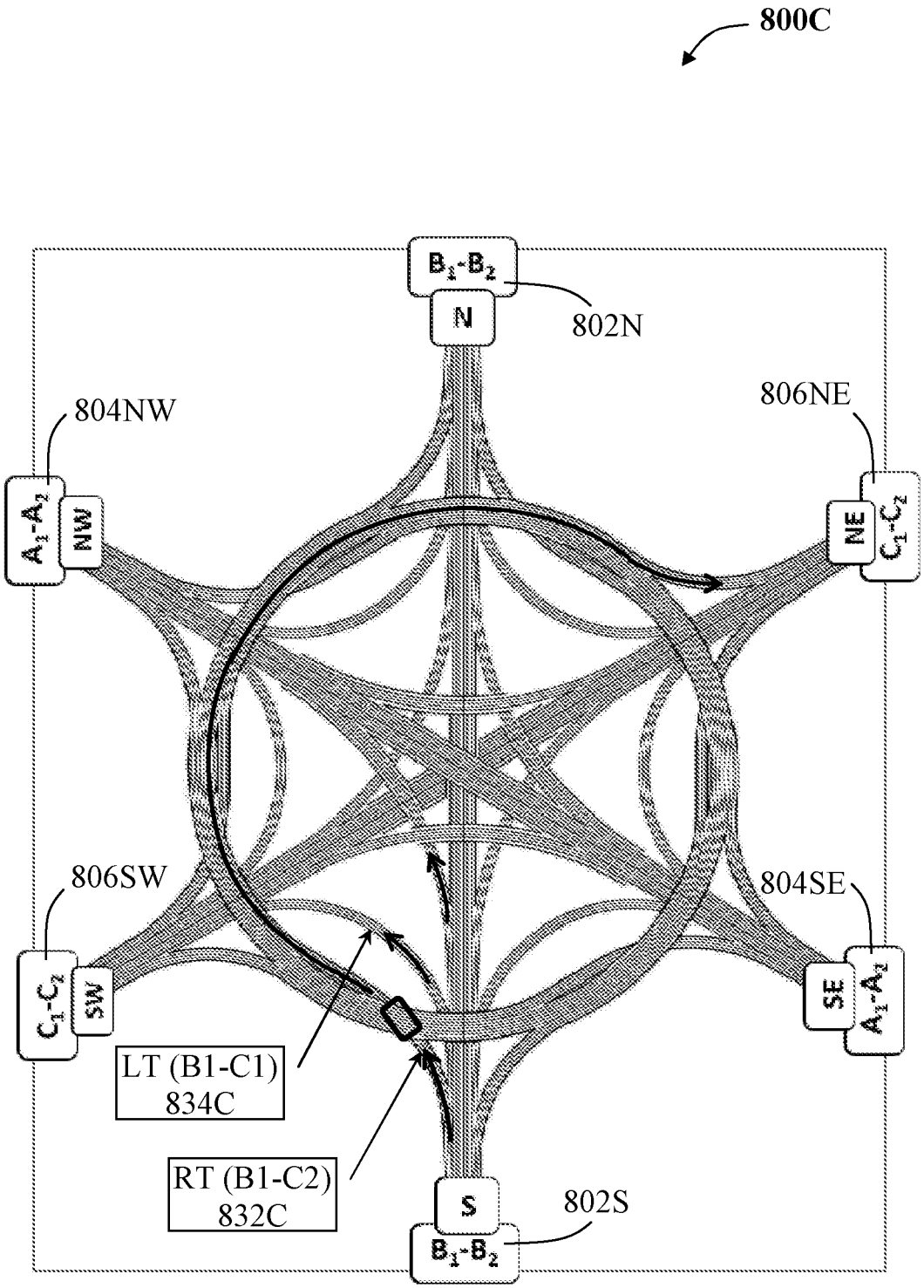
Figure 8D:
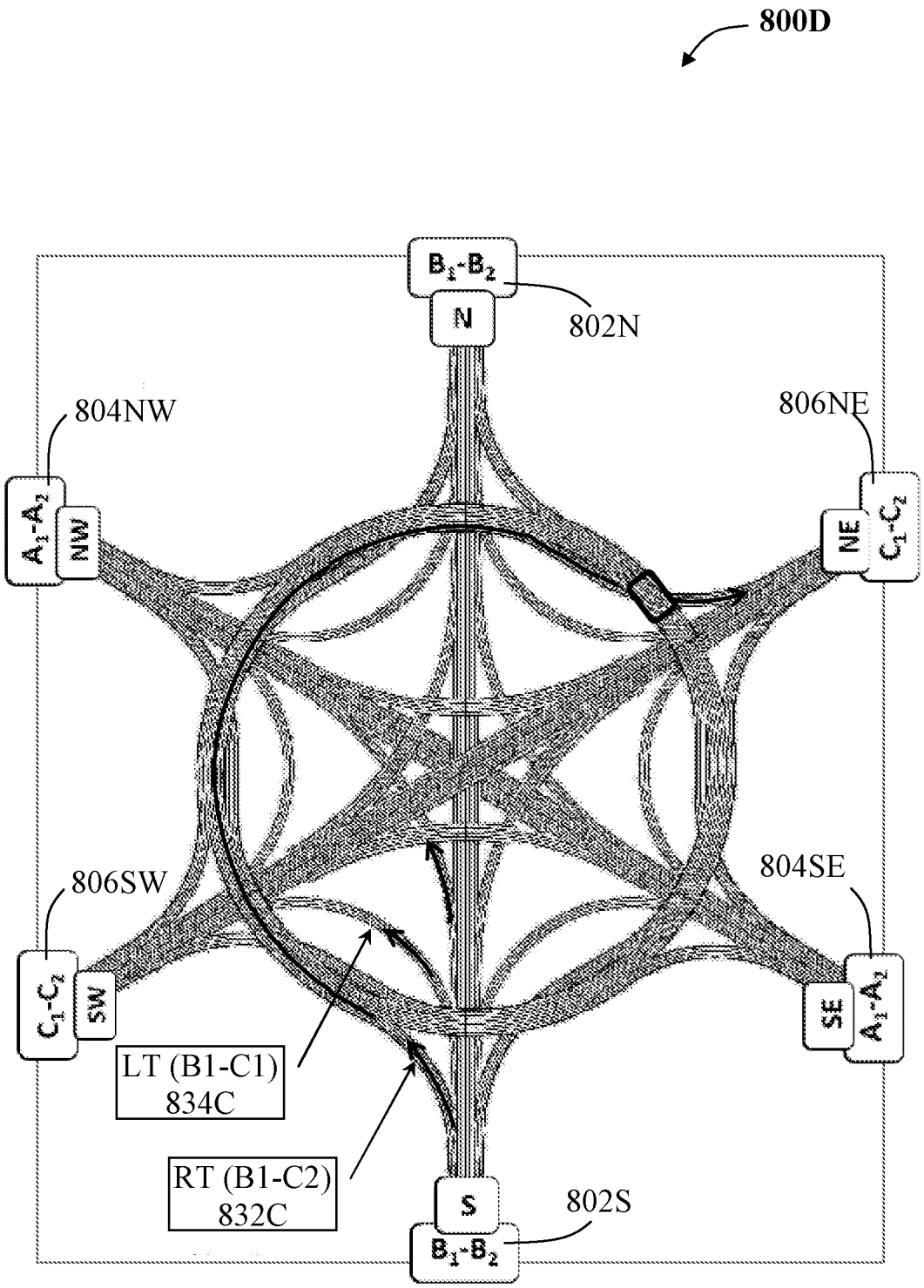

Referring to FIG. 8B, showing a schematic top-view representation of a second six-way road junction embodiment 800B, similar to FIG. 8A, but of an "inward spiral interchange" type for an RHT driving system; FIG. 8C, showing a schematic top-view representation of a third six-way road junction embodiment 800C, similar to FIG. 8A, but for an LHT driving system and FIG. 8D, showing a schematic top-view representation of a fourth six-way road junction embodiment 800D, similar to FIG. 8B, but for an LHT driving system.

Figure 8E:
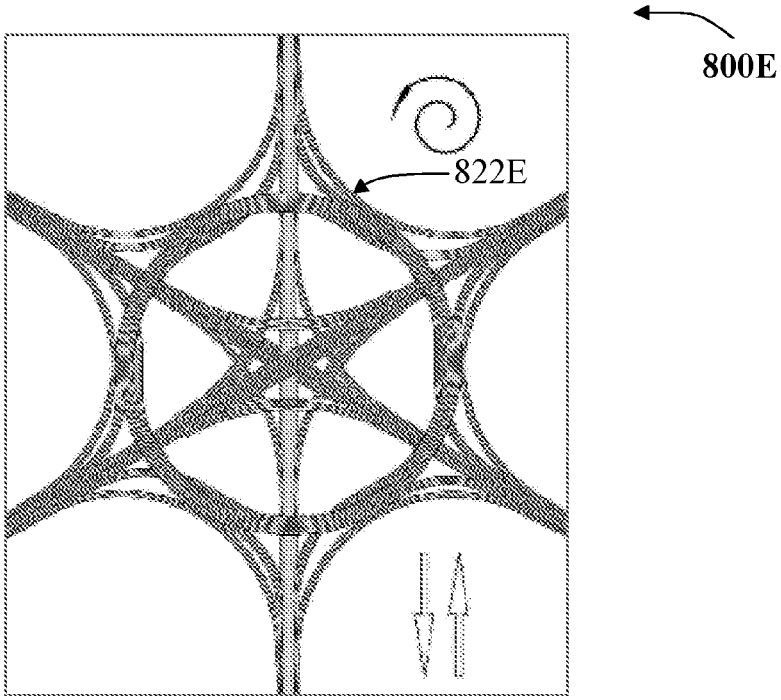
Figure 8F:
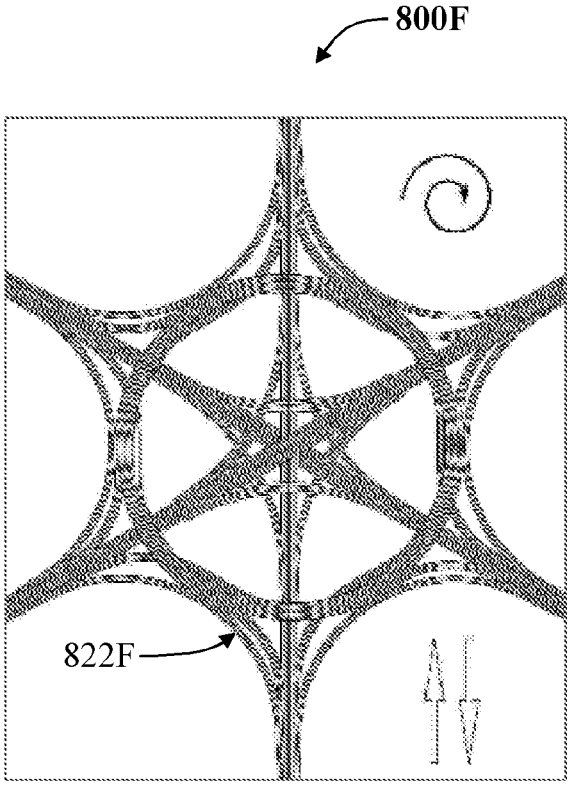

It is further noted that, in a six-way road system, accessing an adjacent highway spoke via an adjacent-spoke connecting road may be configured such that the adjacent-spoke connecting road is positioned outside the disposed area of the ring-road interchange, as illustrated the embodiments of FIG. 8E for an "outward spiral interchange" of an RHT driving system for and in FIG. 8F for an "inward spiral interchange" of an LHT driving system.

Figure 9:
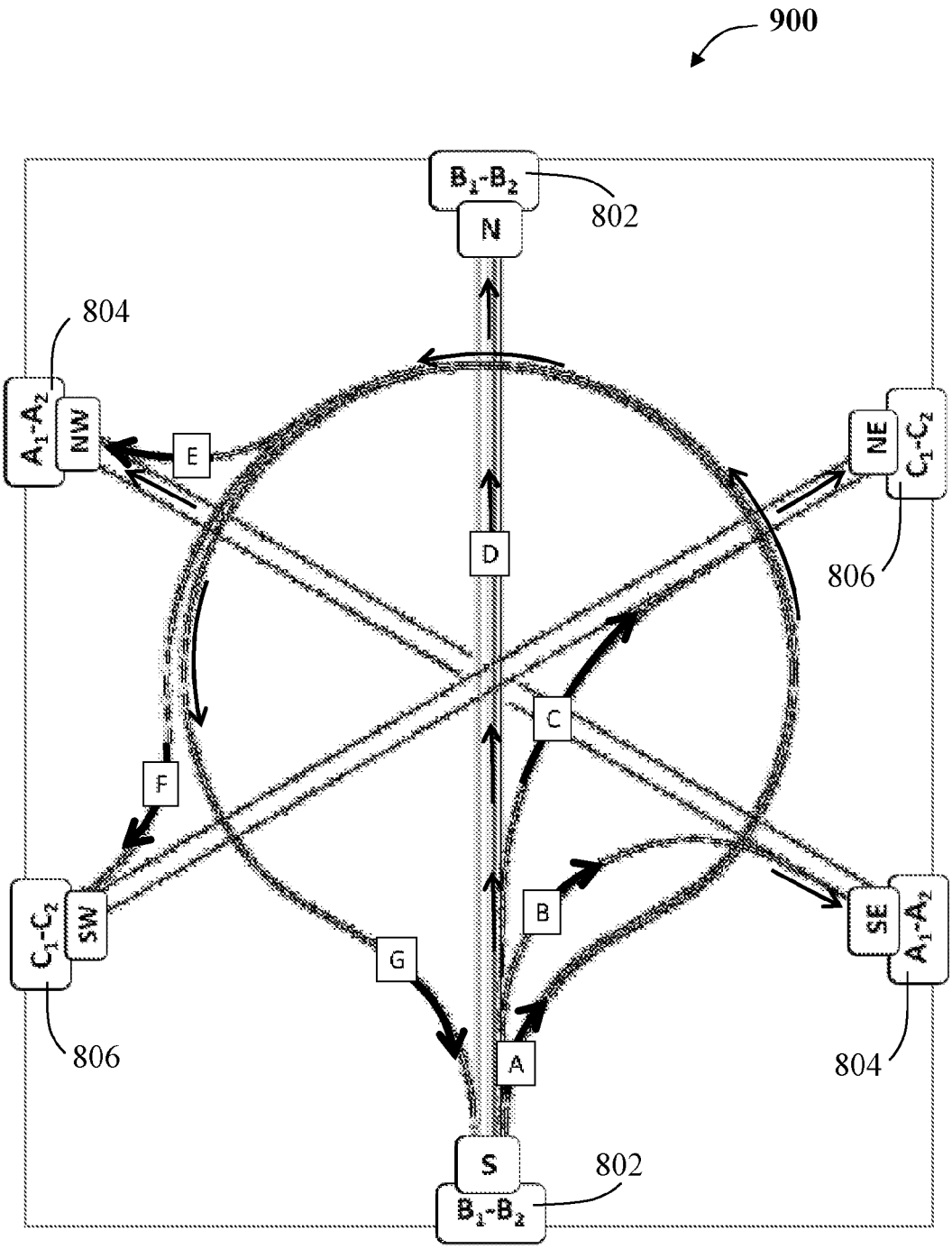
FIG. 9 is a schematic top-view representation of a six-way spiral road junction embodiment of an "inward spiral interchange" type for an RHT driving system, exemplifying un-interrupted traffic access to all possible directions from a specific highway spoke.

Reference is now made to FIG. 9, showing a schematic top-view embodiment 900 of a six-way road junction of an "outward spiral interchange" type for an RHT driving system, exemplifying un-interrupted traffic access to all possible directions from a specific highway spoke.

The schematic top-view embodiment 900 of the six-way spiral road junction includes a north highway spoke 802N having an inbound section B1 and an outbound section B2; a south highway spoke 802S having an inbound section B2 and an outbound section B1; a north-east highway spoke 806NE having an inbound section C1 and an outbound section C2; a south west highway spoke 806SW having an inbound section C2 and an outbound section C1; a south east highway spoke 804SE having an inbound section A1 and an outbound section A2 and an highway spoke 804NW having an inbound section C2 and an outbound section C1.

The six-way spiral road junction, as shown in the schematic top-view embodiment 900 provides access from the inbound section B2 of entry highway spoke 802S to all other exit highway spokes of the six-way spiral road junction, as follows:

Path A, indicates an initial inbound lane of the inbound section B2 (of entry highway spoke 802S) for performing a left turn for joining the A2 outbound section of highway spoke 804NW; or joining the C2 outbound section of highway spoke 806SW; completing the desired left turn.

Path B, indicating a direct path for performing a right turn from the inbound section B2 (of highway spoke 802S) to join the outbound section A1 of highway spoke 804SE via an adjacent-spoke connecting road.

Path C, indicating a direct path for performing a right turn from the inbound section B2 (of entry highway spoke 802S) to join the outbound section C1 of exit highway spoke 806NE via a secondary spoke-traversing link road.

Path D, indicating a direct path from the inbound section B2 (of entry highway spoke 802S) to join the outbound section B2 of exit highway spoke 802N via a primary link road.

Path E, indicating the direct path for completing the left turn from the inbound section B2 (of entry highway spoke 802S) to join the outbound section A2 of exit highway spoke 804NW.

Path F, indicating the direct path for completing the left turn from the inbound section B2 (of entry highway spoke 802S) to join the outbound section C2 of exit highway spoke 806SW.

Path G, indicating the direct path for performing an about-turn correction after starting a left turn from the inbound section B2 (of entry highway spoke 802S) to join the outbound section B1 of exit highway spoke 802S.

Additionally or alternatively, a lower level disposed area under the elevated spiral ring-shaped road surface (105 of FIG. 1, 815A of FIG. 8A, 1215A of FIG. 12A), may be kept clear to accommodate urban or commercial needs, for example. Thus, allowing the adjacent-spoke connecting roads, primary link roads and secondary link roads may be disposed outside the ring shaped road surface.

Figure 10A:
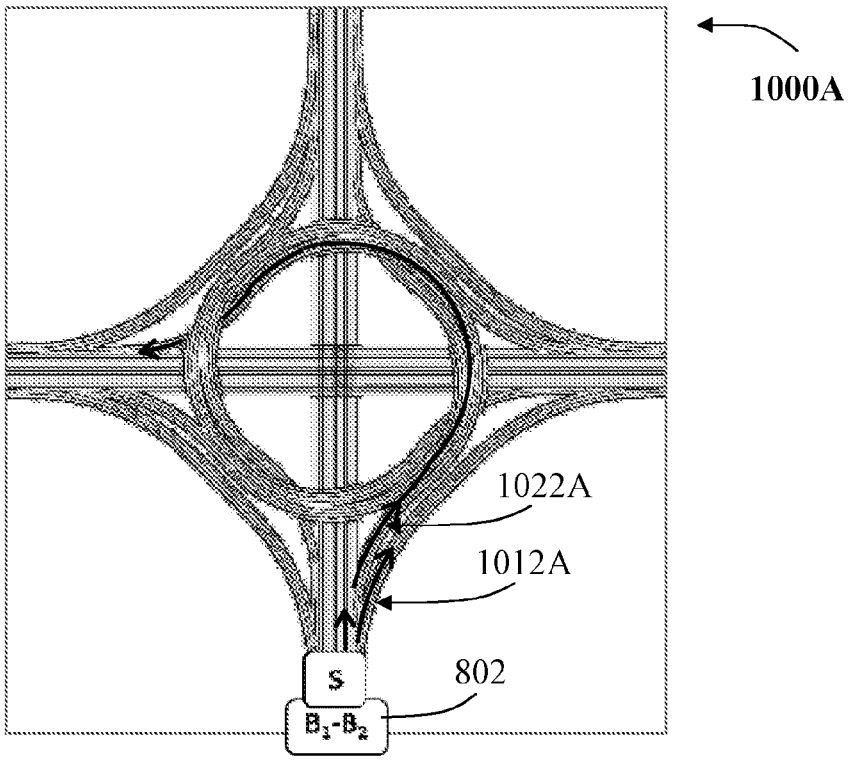
FIGS. 10A-B are schematic top-view representations providing a right turn prior to a left turn in a four-way spiral road junction embodiment of an "outward spiral interchange" type for an RHT and LHT driving systems.

FIG. 10A provides an illustration, for a four-way spiral road junction 1000A of an "outward spiral interchange" type of an RHT driving system, where the right turn may be performed first via an adjacent-spoke connecting road 1012A diverges from the inbound section B2 of highway spoke 802S upstream from the cross-over connecting road, and the left turn may be performed via a slip road 1022A. Further, FIG. 11A shows the lower level 1100A and FIG. 11B shows the upper level 1100B of the four-way spiral road junction 1000A of FIG. 10A.

It is particularly noted that this embodiment provides for a configuration that at least one adjacent-spoke connecting road 1012A may be disposed outside the area contained within the ring-road interchange (FIG. 4, 415).

Figure 10B:
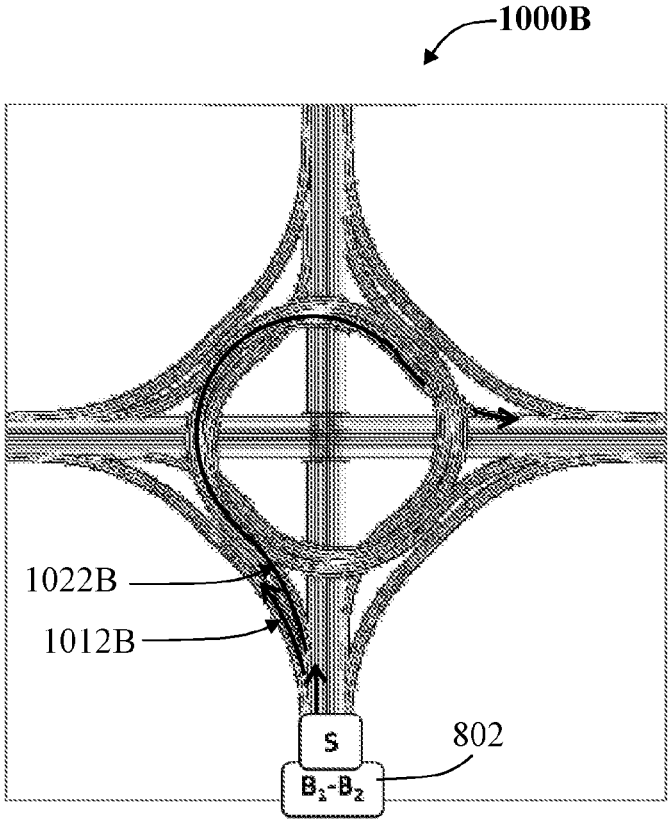

FIG. 10B provides a further illustration, for a four-way spiral road junction 1000B of an "inward spiral interchange" type of an LHT driving system, where the left turn may be performed first via an adjacent-spoke connecting road 1012B, and the right turn may be performed via a slip road 1022B.

Figure 11A:
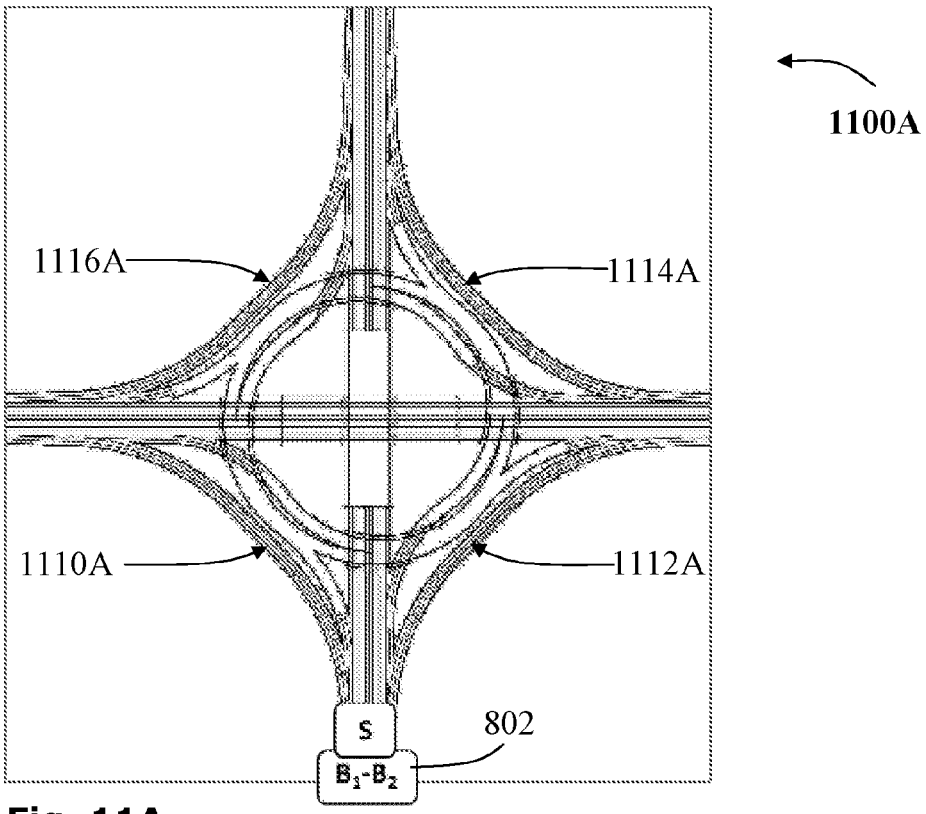
FIG. 11A-B are schematic top-view representations providing the lower and elevated level road system applicable to FIG. 10A.
Figure 11B:
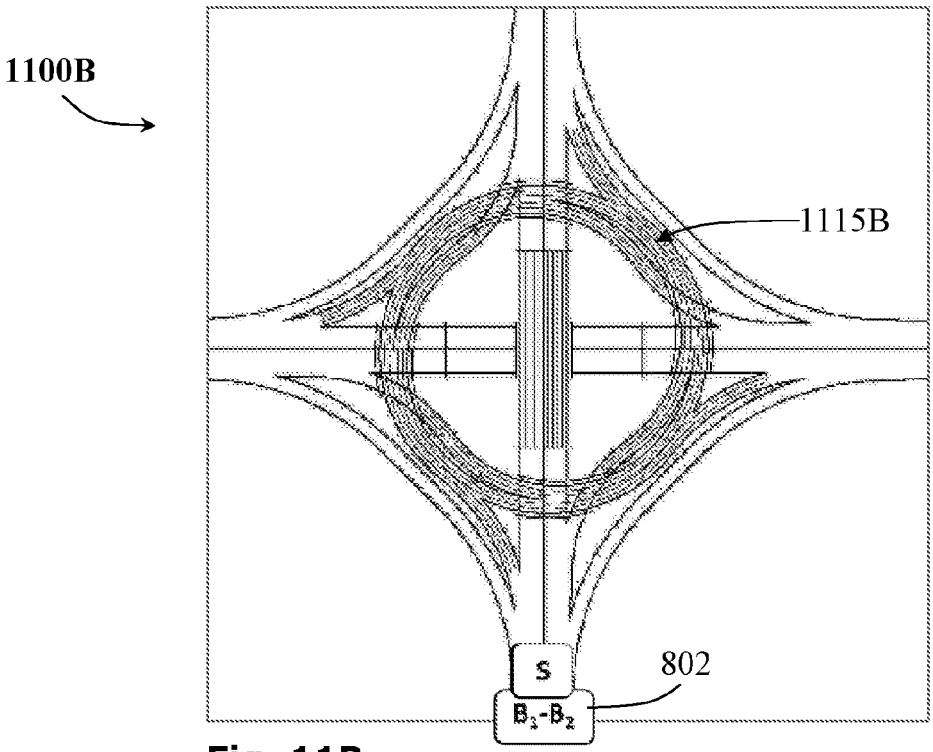
Figure 14A:
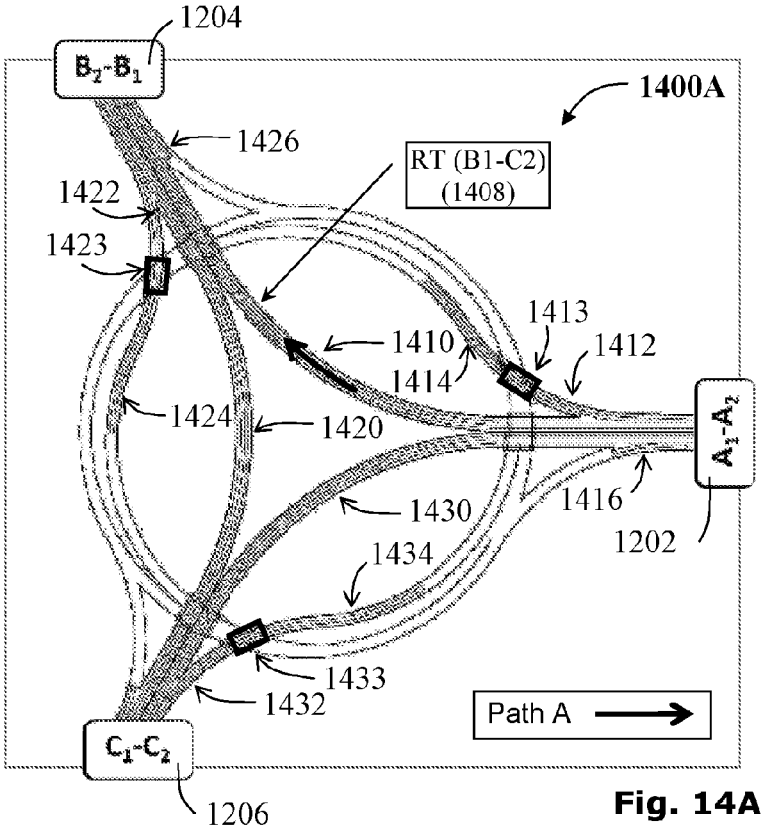
FIGS. 14A-B are schematic representations of a three-way spiral road junction lower and upper level road system embodiment of an "outward spiral interchange" type for an RHT driving system.
Figure 14B:
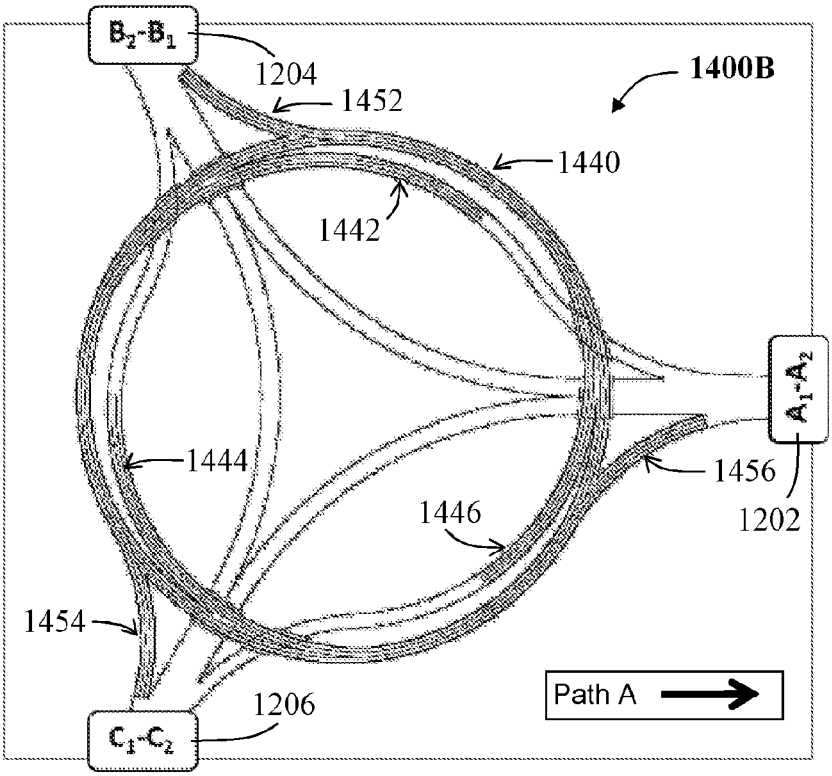

FIGS. 11A and 11B illustrate the road system of a four-way spiral junction road, of "outward spiral interchange" type, where FIG. 11A shows the lower level road system and FIG. 14B shows the elevated road system.

As appropriate, the associated adjacent-spoke connecting roads such as the adjacent-spoke connecting road 1112A (FIG. 11A), are configured to lie outside the central area disposed by the ring-road interchange 1115B (FIG. 11B).

Where appropriate and by way of example, the lower and elevated road system of the spiral road junction are further detailed for a four-way spiral junction, hereinbefore, as described in FIGS. 5A-B.

Three-Way Spiral Junction System

The following embodiments describe various aspects of a three-spoke spiral junction applicable in an RHT driving system such as accustomed in Europe, USA, Canada, China and others and in an LHT driving system such as accustomed in the UK, Japan, Australia and others.

Figure 12A:
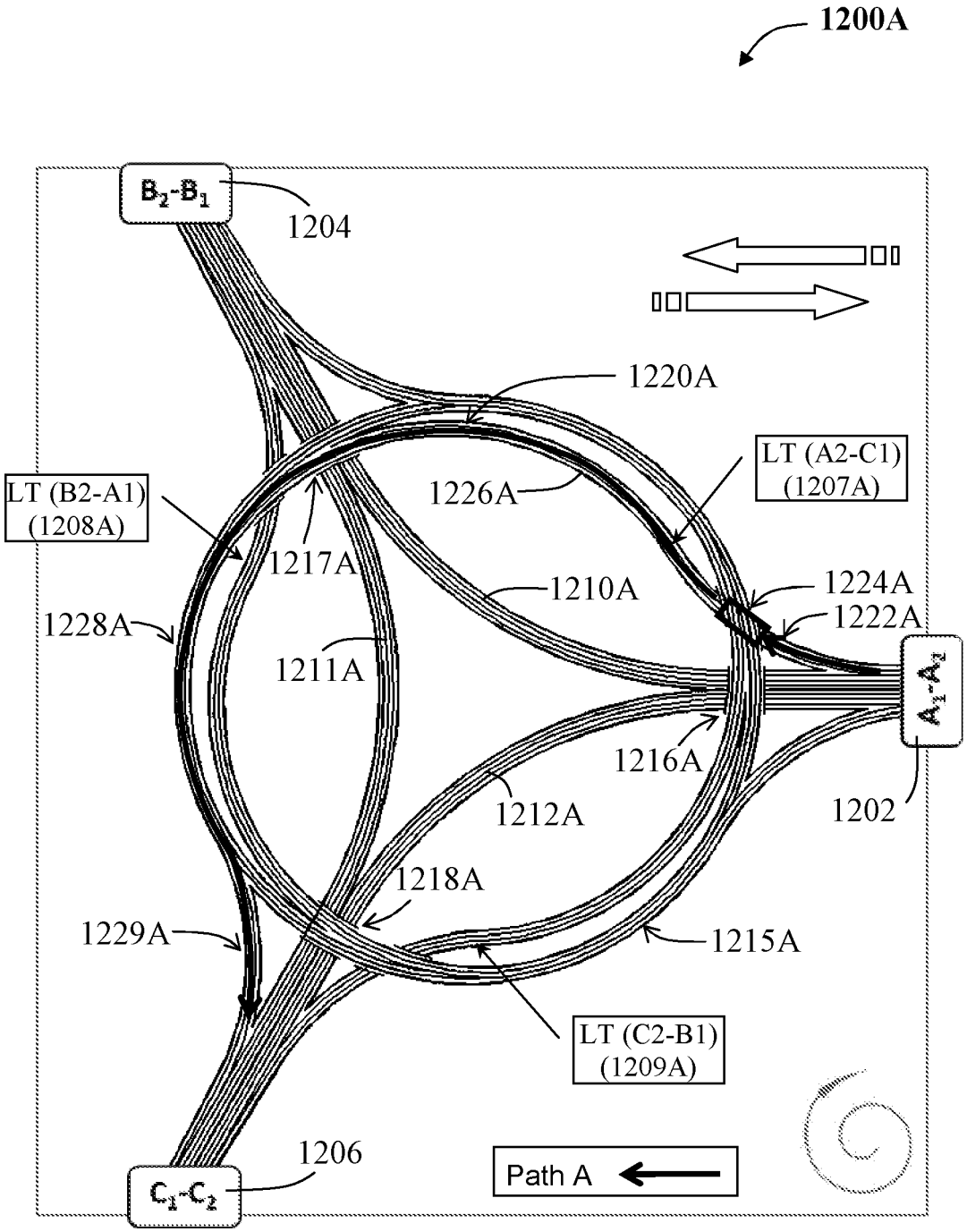
FIGS. 12A-B are schematic representations of a three-way spiral road junction embodiments of an outward and inward spiral interchange type for an RHT driving system.

Reference is now made to FIG. 12A, showing a schematic representation of a three-way spiral road junction 1200A of an "outward spiral interchange" type for an RHT driving system.

The spiral road junction 1200A includes three highway spokes: a first highway spoke 1202 having an outbound section A1 and an inbound section A2; a second highway spoke 1204 having an outbound section B1 and an inbound section B2; a third highway spoke 1206 having an outbound section C1 and an inbound section C2 and a ring-shaped road surface 1215A.

The spiral road junction 1200A further includes a ring-shaped road surface 1215A providing a ring-road interchange comprising a plurality of spoke-traversing crosspasses where each said crosspass traversing a highway spoke.

Then ring-shaped surface 1215A provides a ring-road interchange enabling cross-over connecting roads associated with each highway spoke, Each cross-over connecting road, provides the continuous path 1220A from an entry highway spoke 1202 to an exit highway spoke 1206, including a slip road 1222A providing access from the inbound section of the entry highway spoke 1202, a ring-traversing crosspass segment 1224A, an inner connecting segment 1226A, a ring-road interchange segment 1228A and an access road 1229A to the outbound section of the exit highway spoke 1206.

It is noted that the ring-road interchange segment 1228A may traverse all intermediate highway spokes between an entry highway spoke and an exit highway spoke. Further, the ring-traversing crosspass segment 1224A provides a passage between the inside and the outside of the ring-shaped road surface 1215A.

Accordingly, the continuous path 1220A provides a left turn path 1207A (A2-C1) as indicated by the arrowed path A, leaving an outbound lane of the inbound section A2 of entry highway spoke 1202 to join an outbound lane of the outbound section C1 of exit highway spoke 1206.

Similarly, there may exist another dedicated and continuous path for a left turn 1208A (B2-A1) from entry highway spoke 1204 to exit highway spoke 1202 along a path leaving an inbound lane of inbound section B2 of the entry highway spoke 1204 to join an outbound lane of outbound section A1 of the exit highway spoke 1202. Further, there may exist a dedicated and continuous path for a left turn path 809A (C2-B1) from entry highway spoke 1206 to exit highway spoke 1204 along a path leaving an inbound lane of inbound section C2 of the entry highway spoke 1206 to join an outbound lane of the outbound section B1 of the exit highway spoke 1204.

The spiral road junction 1200A further includes an adjacent-spoke connecting road associated with each highway spoke such as the adjacent-spoke connecting road 1210A associated with highway spoke 1202, a ring-road interchange 1215A comprising three crosspasses 1216A, 1217A, 1218A.

Additionally, the direct paths for right turns may use the direct road 110A to turn right from highway spoke 1202 to highway spoke 1204, adjacent-spoke connecting road 1211A to turn right from highway spoke 1204 to highway spoke 1206 and adjacent-spoke connecting road 1212A turn right from highway spoke 1206 to highway spoke 1202. Thus, the direct paths be configured to leave at least one inbound lane of inbound section A2 of the highway spoke 1202 to join the at least one outbound lane of inbound section B2 of highway 1204; leave the at least one inbound lane of inbound section B2 of highway spoke 1204 to join the at least one outbound lane of inbound section C1 of highway 1206; and leave the at least one inbound lane of outbound section C2 of highway spoke 106A to join the at least one outbound lane of inbound section A1 of the highway spoke 1202.

It is noted that the ring-shaped road surface 1215A of the three-way spiral junction road 1210A of the "outward spiral interchange" type is configured to cross over the slip road 1222A. Further, traffic travelling along the inner connecting segment 1226A joins the ring-road interchange segment 1228A from the inside, providing a continuous path to allow traffic to flow continuously, with no need to intersect lanes, thus, avoiding any traffic lights, ramps usage and the like.

It is further noted that according to the embodiment, as the direct turns via the ring-road interchange are accessible by inbound traffic downstream the adjacent turns, the adjacent-spoke connecting roads 1210A, 1211A, 1212A are all contained within the ring-road interchange 1215A such that the footprint and structural area of the interchange is kept to a minimum and may answer various urban needs. As appropriate, the adjacent-spoke connecting road is disposed within the area contained within said ring-road interchange 1215A.

Where appropriate, the ring-road interchange 1200A allows for corrections and about-turns, as described hereinafter.

Optionally, the ring-road interchange 1215A of the spiral road junction provides for a continuous crosspass on one level.

Where appropriate, the ring-traversing crosspass 1224A may be selected from a group consisting of an underpass crossing, an overpass crossing, a bridge, a tunnel, a cutting or combinations thereof.

Figure 12B:
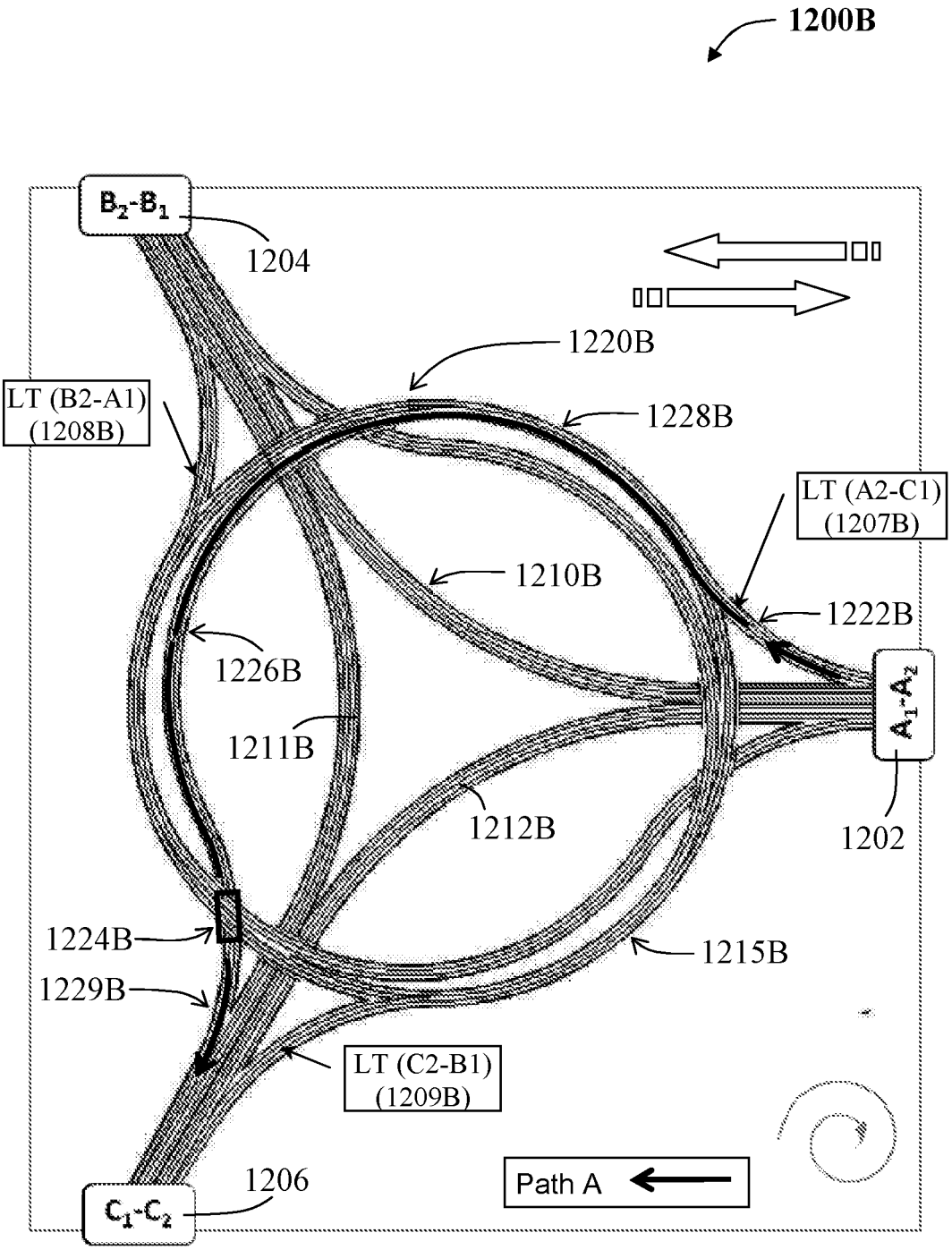

Reference is now made to FIG. 12B, showing a schematic representation of a three way road junction 1200B of an "inward spiral interchange" type for an RHT driving system.

The spiral road junction 1200B includes three highway spokes: highway spoke 1202 having an outbound section A1 and an inbound section A2; highway spoke 1204 having an outbound section B1 and an inbound section B2; highway spoke 1206 having an outbound section C1 and an inbound section C2 and a cross-over connecting road associated with each highway spoke, provides a continuous path from the inbound section of an entry highway spoke to an outbound section of an exit highway spoke, such as the continuous path 1220B which provides a path from the inbound section A2 of the entry highway spoke 1202 to the outbound section C1 of the exit highway spoke 1206, thereby allowing a left turn as described hereinafter. The spiral road junction 1200B further includes an adjacent-spoke connecting road associated with each highway spoke such as the adjacent-spoke connecting road 1210B associated with highway spoke 1202, a ring-road interchange 1215B comprising three crosspasses.

The cross-over connecting road, providing the continuous path 820B, associated with the entry highway spoke 1202 and the exit highway spoke 106A, includes a slip road 1222B providing access from the inbound section of the associated highway spoke 1202, a ring-road interchanged spiral segment 1228B, an inner connecting segment 1228B and a ring-traversing crosspass segment 1224B and an access road segment 1229B to the exit highway spoke 1206.

Accordingly, the continues path 1220B specifies a left turn path 1207B (A2-C1) as indicated by the arrowed path A, leaving an inbound lane of the inbound section A2 of entry highway spoke 1202 to the join an outbound lane of the outbound section C1 of exit highway spoke 1206.

Similarly, there may exist another dedicated and continuous path for a left turn path 1208B (B2-A1) from entry highway spoke 1204 to exit highway spoke 1202 along a path leaving an inbound lane of inbound section B2 of the entry highway spoke 1204 to join an outbound lane of outbound section A1 of the highway spoke 1202. Further, there may exist a dedicated and continuous path for a left turn path 1209B (C2-B1) from entry highway spoke 1206 to exit highway spoke 1204 along a path leaving the an inbound lane of inbound section C2 of the entry highway spoke 1206 to join an outbound lane of the outbound section B1 of the exit highway spoke 1204.

Additionally, the direct paths for right turns may use the adjacent-spoke connecting road 1210B to turn right from highway spoke 1202 (A2) to highway spoke 1204 (B1), adjacent-spoke connecting road 1211B to turn right from highway spoke 1204 (B2) to highway spoke 106B (C1) and adjacent-spoke connecting road 1212B to turn right from highway spoke 1206 (C2) to highway spoke 1202 (A1).

It is noted that traffic travelling along the slip road 1222B joins with the ring-road interchange 1215B of the three-way spiral junction road 1210B of the "inward spiral interchange" type via the ring-road interchanged segment 1228B from the outside. Further, the inner connecting segment 1226B traverses the ring-road interchange 1215B via the ring-traversing crosspass segment 1224B, providing a continuous path to allow traffic to stream continuously, with no need to intersect lanes, thus, avoiding any for traffic lights, ramps usage and the like.

It is further noted that according to the embodiment, as the direct turns via the ring-road interchange are accessible by inbound traffic upstream the direct turns, the adjacent-spoke connecting roads 1210B, 1211B, 1212B are all contained within the ring-road interchange 1215B such that the footprint and structural area of the interchange is kept to a minimum and may answer various urban needs.

Where appropriate, the ring-road interchange 1200B allows for corrections and about-turns, as described hereinafter.

Optionally, the ring-road interchange 1215B of the spiral road junction provides for a continuous crosspass on one level.

Figure 13A:
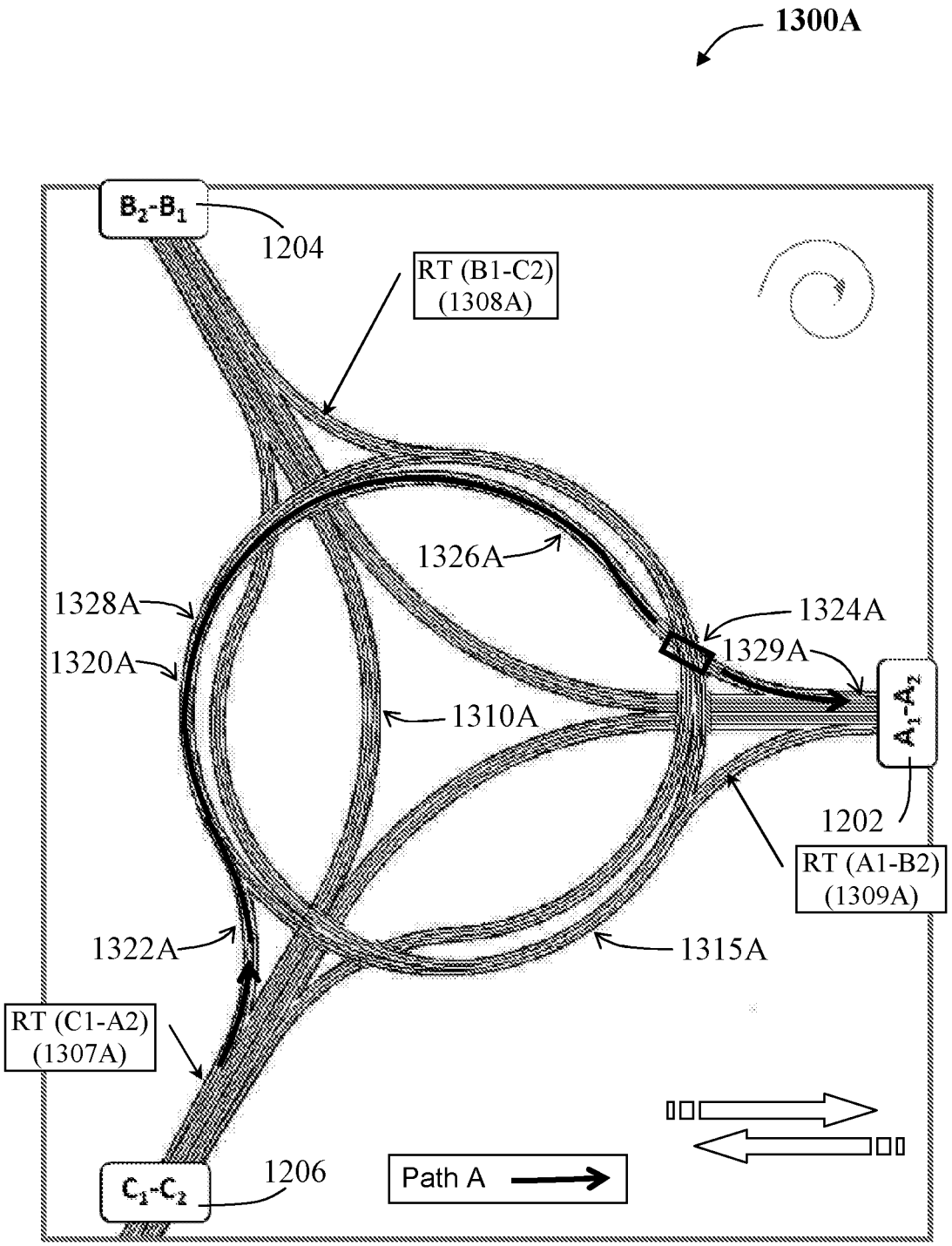
FIGS. 13A-B are schematic representations of a three-way spiral road junction embodiment of an inward and outward spiral interchange type for an LHT driving system.
Figure 13B:
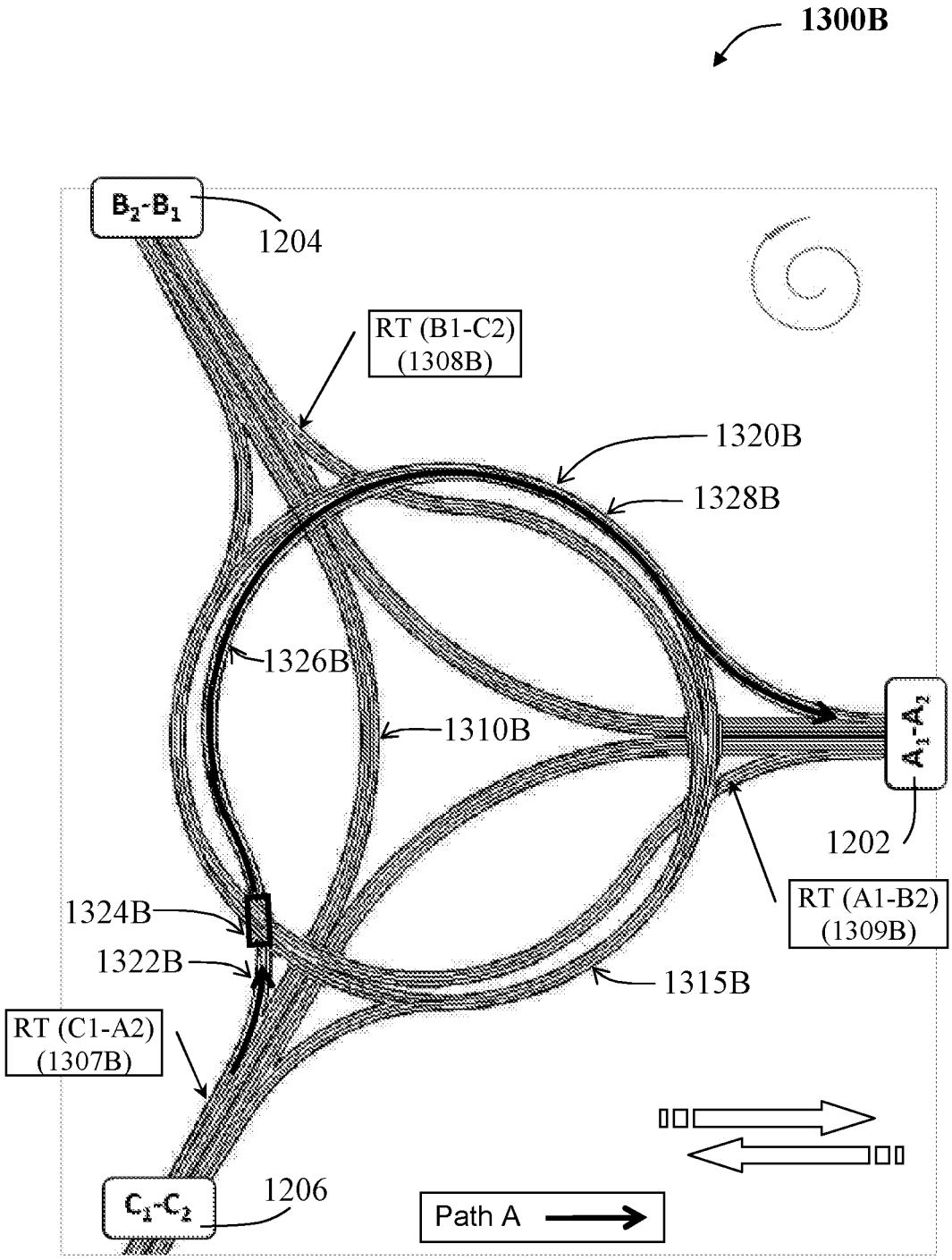

It is noted that FIGS. 13A-B show similar schematic representations as described hereinabove in FIGS. 12A-B, but for a three-way LHT spiral interchange.

FIG. 13A shows a schematic representation of a three-way road junction 1300A of an "inward spiral interchange" type for an LHT driving system, and FIG. 13B shows a schematic representation of a three-way road junction 1300B of an "outward spiral interchange" type for an LHT driving system.

Road System—Lower/Upper Level:

FIGS. 14A and 14B illustrate the road system of a three-way spiral junction road, of "outward spiral interchange" type, where FIG. 14A shows the lower level road system and FIG. 14B shows the upper road system.

Where appropriate and by way of example, the lower and upper road system of the spiral road junction are further detailed for a four-way spiral junction, hereinbefore, as described in FIGS. 5A-B.

Figure 15:
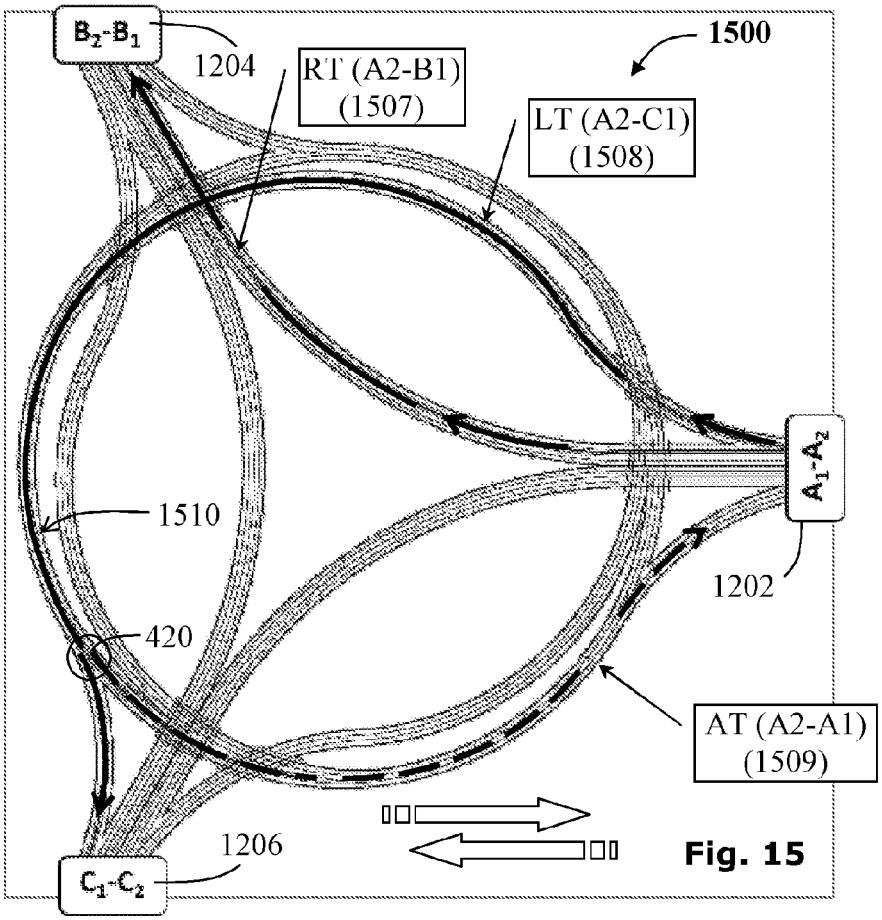
FIG. 15 is a schematic representation of a three-way spiral road junction of possible driving directions of an "outward spiral interchange" type for an RHT driving system.

Traffic Flow and Corrections:

Reference is now made to FIG. 15, showing an embodiment of a schematic representation 1500 of possible driving directions in a three-way road junction of an "outward spiral interchange" type for an RHT driving system.

The three-way road junction embodiment 1500 includes an illustration of possible traffic directions via each of the three highway spokes, such the continuous path 1510, as indicated by the arrowed traffic flow from the inbound section A2 to outbound section C1, and allowing a correction of an about-turn back to the outbound section A1 of the entry highway spoke 1202.

The direct turn 1507 (A2-B1) is directed to leaving the inbound section A2 of highway spoke 1202 to join outbound section B1 of highway spoke 1204; the cross-over turn 1508 (A2-C1) is directed to leave the inbound section A2 of highway spoke 1202 to join outbound section C1 of highway spoke 1206; and the about-turn 1509 (A2-A1).

It is particularly noted that a correction region 420 may be provided, disposed along the ring-road interchange segment diverging from the cross-over connecting road allowing to disrupt the continuous path 1510 to apply modifications such as an about-turn, returning back to the outbound section of the entry highway spoke, as indicated by the dashed arrowed line 1509 (A2-A1), keeping a single continuous lane, with no need of crossing other traffic lanes (no weaving). Optionally, the correction region 420 may be disposed upstream from the access road segment (FIG. 8A, 829A).

It is noted that similar driving options may be applicable to highway spoke 1204 (B1-B2) and highway spoke 1204 (C1-C2).

It is further noted that the correction region 420 may allow various driving actions, such as an about-turn, returning back to the outbound section of the entry highway spoke keeping the same continuous driving path, changing the driving path by leaving the current driving lane to another driving lane, serving as a free entry space to other lanes, merging area of various lanes, and the like, as described hereinafter in FIG. 16.

Figure 16:
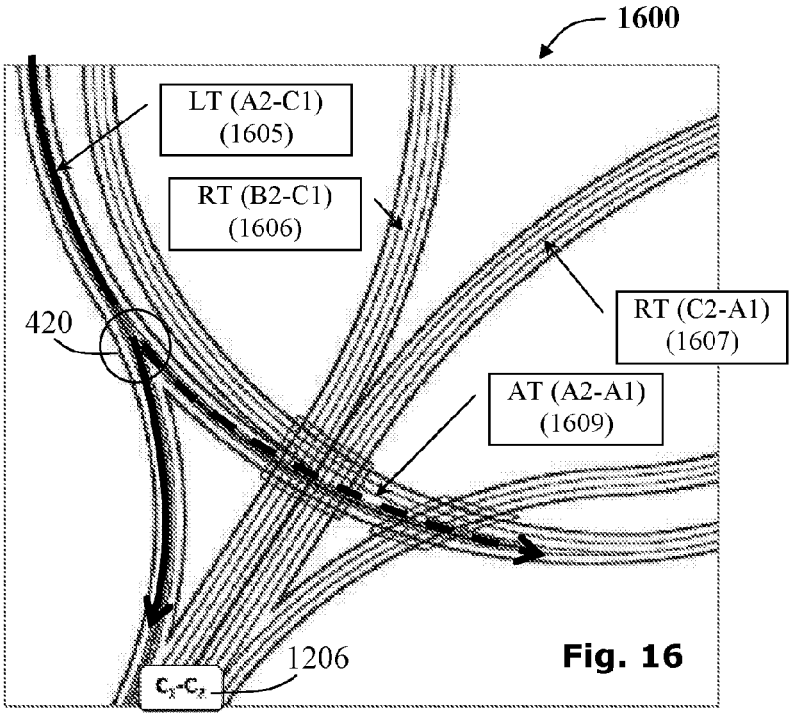
FIG. 16 is a schematic representation of a three-way spiral road junction of possible driving corrections and about-turns of an "outward spiral interchange" type for a RHT driving system.

Reference is now made to FIG. 16, showing a schematic enlargement 1600 embodiment of a possible correction region 420 of a three-way road junction of an "outward spiral interchange" type for an RHT driving system.

The enlargement view 1600 includes a left turn 1605 from inbound section A2 associated with an entry highway spoke 1202 (FIG. 15) to outbound section C1 associated with an exit highway spoke 1206 (FIG. 15); a right turn 1606 from inbound section B2 associated with the highway spoke 1204 (FIG. 15) to outbound section C1 associated with the highway spoke 1206 (FIG. 15); a right turn 1607 from inbound section C2 associated with the highway spoke 1206 leading to the outbound section A1 associated with the highway spoke 1202; and an about-turn 1609 (A2-A1).

A road user attempting to turn from the inbound section A2 of the highway spoke 1202 towards the outbound section C1 of the highway spoke 106A, for example, along the left turn path 1205, may abort the attempted turn and correct the driving direction in the correction region 420, for example, by changing lanes, the road user may return back along the outbound section A1 of the highway spoke 1202. Furthermore, by performing another lane change at another correction region further along the path, the road user may access the outbound section B1 of the highway spoke 1204.

Figure 17:
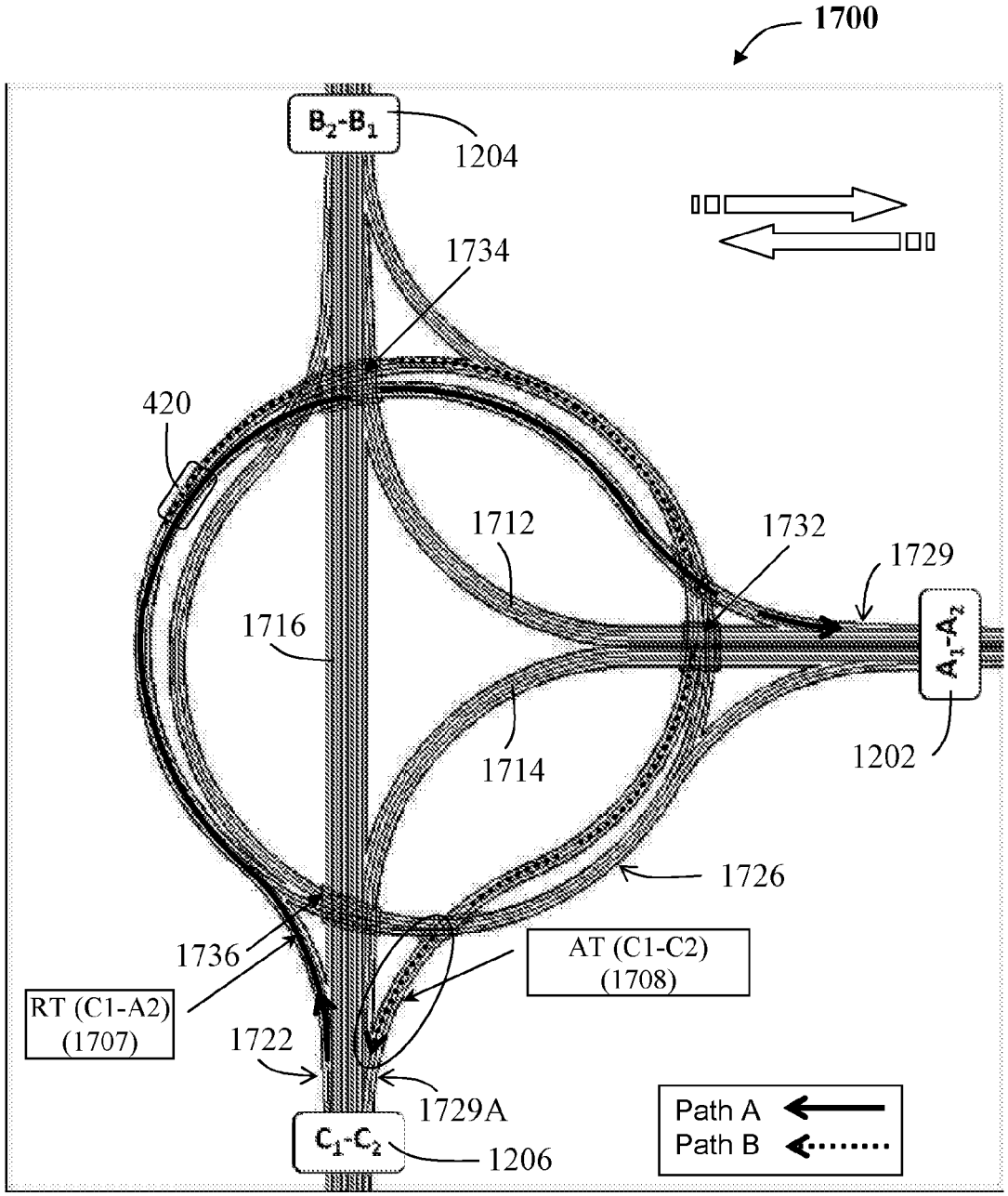
FIG. 17 is a schematic representation of a three-way "T" shaped spiral road junction of possible driving corrections and about-turns of an "outward spiral interchange" type for an LHT driving system.

Reference is now made to FIG. 17, showing another embodiment 1700 of a three-way "T" shaped road junction of an "outward spiral interchange" type for an LHT driving system, with schematic representation of possible driving directions.

The three-way "T" shaped road junction embodiment 1700 includes an illustration of possible traffic directions via a three highway spokes system; a first highway spoke 1202 having an inbound section A1 and an outbound section A2, a second highway spoke 1204 having an inbound section B1 and an outbound section B2 and a third highway spoke 1206 having an inbound section C1 and an outbound section C2. The spiral "T" shaped road junction 1700 further includes an adjacent-spoke connecting road 1712 providing direct access for a left turn (B1-A2), an adjacent-spoke connecting road 1714 providing direct access for a left turn (A1-C2), and an adjacent-spoke connecting road 1716 providing straight adjacent-spoke connecting road of (C1-B1) and (B2-C2), forming a "T" shaped road junction. The ring-road interchange 1726 further provides possible right turns and allows various corrections, such as performing an about-turn, as described hereinafter.

The three-way "T" shaped road junction embodiment 1700, further includes a spoke-traversing crosspass 1732 associated with highway spoke 1202, a spoke-traversing crosspass 1734 associated with highway spoke 1204, a spoke-traversing crosspass 1736 associated with highway spoke 1736.

The right turn 1707, as indicated by the arrowed path A, provides the traffic with the possibility of performing a right turn leaving the inbound section C1 of the third highway spoke 1206 via a slip road 1722 through the spiral ring-road interchange 1726 to join the outbound section A2 of the second highway spoke 1202 via the slip road 1729. The correction region 420 provides a possible correction and disrupting the continuous path, to allow an about-turn 1708, as indicated by the dashed arrowed path B, provides the traffic with the possibility of performing an about-turn to return along the inbound section C1 of the third highway spoke 1706 to the outbound section of C2 via the slip road 1729A.

Technical and scientific terms used herein should have the same meaning as commonly understood by one of ordinary skill in the art to which the disclosure pertains. Nevertheless, it is expected that during the life of a patent maturing from this application many relevant systems and methods will be developed. Accordingly, the scope of the terms such as computing unit, network, display, memory, server and the like are intended to include all such new technologies a priori.

The terms "comprises", "comprising", "includes", "including", "having" and their conjugates mean "including but not limited to" and indicate that the components listed are included, but not generally to the exclusion of other components. Such terms encompass the terms "consisting of" and "consisting essentially of".

The phrase "consisting essentially of" means that the composition or method may include additional ingredients and/or steps, but only if the additional ingredients and/or steps do not materially alter the basic and novel characteristics of the composition or method.

As used herein, the singular form "a", "an" and "the" may include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments or to exclude the incorporation of features from other embodiments.

The word "optionally" is used herein to mean "is provided in some embodiments and not provided in other embodiments". Any particular embodiment of the disclosure may include a plurality of "optional" features unless such features conflict.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable sub-combination or as suitable in any other described embodiment of the disclosure. Certain features described in the context of various embodiments are not to be considered essential features of those embodiments, unless the embodiment is inoperative without those elements.

Although the disclosure has been described in conjunction with specific examples thereof, it is evident that many alternatives, modifications and variations will be apparent to those skilled in the art. Accordingly, it is intended to embrace all such alternatives, modifications and variations that fall within the spirit and broad scope of the disclosure.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present disclosure. To the extent that section headings are used, they should not be construed as necessarily limiting.

The invention claimed is:

1. A spiral road junction system connecting a plurality of highway spokes, said spiral road junction comprising:

at least one cross-over connecting road associated with each said highway spoke, said cross-over connecting road providing a continuous path from the inbound section of an entry highway spoke to the outbound section of an exit highway spoke, wherein said spiral road junction further comprises:

a ring-road interchange comprising a continuous ring-shaped road surface traversing a plurality of spoke-traversing crosspasses, each spoke-traversing crosspass traversing a highway spoke; and said cross-over connecting road comprises:

a slip road diverging from the inbound section of said entry highway spoke;

an access road converging with the outbound section of said exit highway spoke;

a ring-road interchange segment, said segment traversing all intermediate highway spokes between said entry highway spoke and said exit highway spoke;

a ring-traversing crosspass segment providing a passage between the inside and the outside of said ring-road interchange; and an inner connecting segment connecting the inside of said ring-traversing crosspass segment to said ring-road interchange;

wherein said continuous path comprises at least one lane configured to provide a traffic-flow from said inbound section of said entry highway spoke along said ring-road interchange to said outbound section of said exit highway spoke, said traffic-flow requiring no crossing of lanes.

2. The spiral road junction system of claim 1, further comprising at least one adjacent-spoke connecting road associated with each said highway spoke, said at least one adjacent-spoke connecting road connecting the inbound section of said entry highway spoke and the outbound section of an adjacent highway spoke.

3. The spiral road junction system of claim 2, wherein said at least one adjacent-spoke connecting road is disposed within the area contained within said ring-road interchange.

4. The spiral road junction system of claim 2, wherein said at least one adjacent-spoke connecting road is disposed outside the area contained within said ring-road interchange.

5. The spiral road junction system of claim 2, wherein said at least one cross-over connecting road diverges from said inbound section of said entry highway spoke upstream from said at least one adjacent-spoke connecting road.

6. The spiral road junction system of claim 1, being configured for connecting at least four highway spokes further comprising at least one flyover intersection comprising at least a first link road connecting a first pair of said highway spokes, and at least one second link road connecting a second pair of said highway spokes, wherein said first link road traverses said second link road via a flyover intersection crosspass.

7. The spiral road junction system of claim 6, wherein said at least one flyover intersection crosspass comprises at least one of a bridge, a tunnel, and a cutting.

8. The spiral road junction system of claim 6, being configured for connecting at least six highway spokes wherein said at least one flyover intersection further comprises at least a third link road connecting a third pair of said highway spokes, said second link road traversing said third link road via a second flyover intersection crosspass.

9. The spiral road junction system of claim 1, wherein said ring-road interchange further comprises at least one correction region disposed along said ring-road interchange segment diverging from said cross-over connecting road.

10. The spiral road junction system of claim 9, wherein said correction region is disposed upstream from said access road.

11. The spiral road junction system of claim 9, comprising at least one diverging region diverging from said cross-over connecting road and at least one converging region rejoining said ring-road interchange.

12. The spiral road junction system of claim 1, wherein said ring-road interchange comprises a continuous crosspass on one level.

13. The spiral road junction system of claim 1, wherein said slip road comprises an inward spiral converging with said ring-road interchange from outside.

14. The spiral road junction system of claim 1, wherein said slip road comprises an outward spiral converging with said ring-road interchange from inside.

15. The spiral road junction system of claim 1, wherein said ring-traversing crosspass section is selected from a group consisting of an underpass crossing, an overpass crossing, a bridge, a tunnel, a cutting or combinations thereof.

16. The spiral road junction system of claim 1, wherein said spoke-traversing crosspass is selected from a group consisting of an underpass crossing, an overpass crossing, a bridge, a tunnel, a cutting or combinations thereof.

* * * * *